US012667191B2

(12) United States Patent
Beyer et al.

(10) Patent No.: US 12,667,191 B2
(45) Date of Patent: Jun. 30, 2026

(54) WEIGHT RESPONSIVE CHAIR

(71) Applicant: Haworth, Inc., Holland, MI (US)

(72) Inventors: Peter J. Beyer, Hamilton, MI (US); Kyle R. Fleet, Zeeland, MI (US); Teresa A. Bellingar, Holland, MI (US); Mark J. Sherman, Zeeland, MI (US); John A. Colasanti, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 144 days.

(21) Appl. No.: 18/382,257

(22) Filed: Oct. 20, 2023

(65) Prior Publication Data

US 2025/0127302 A1 Apr. 24, 2025

(51) Int. Cl.
*A47C 1/032* (2006.01)
*A47C 7/44* (2006.01)

(52) U.S. Cl.
CPC ..... *A47C 1/03272* (2013.01); *A47C 1/03255* (2013.01); *A47C 7/44* (2013.01); *A47C 7/445* (2013.01)

(58) Field of Classification Search
CPC ..... A47C 7/44; A47C 7/445; A47C 1/03272; A47C 1/03255
See application file for complete search history.

(56) References Cited

U.S. PATENT DOCUMENTS 2,818,911 A 1/1958 Syak
3,369,840 A 2/1968 Dufton
4,077,596 A 3/1978 Pinaire et al.
4,387,876 A 6/1983 Nathan
4,479,679 A 10/1984 Fries et al.
4,653,806 A 3/1987 Willi
4,709,963 A 12/1987 Uecker et al.
4,711,491 A 12/1987 Ginat
4,761,033 A 8/1988 Lanuzzi et al.
4,763,950 A 8/1988 Tobler
4,765,679 A 8/1988 Lanuzzi et al.
4,840,426 A 6/1989 Vogtherr et al.
(Continued)

FOREIGN PATENT DOCUMENTS

DE 3700447 A1 7/1988
DE 4208648 C1 5/1993
(Continued)

*Primary Examiner* — Rodney B White

(74) *Attorney, Agent, or Firm* — Warner Norcross + Judd LLP

(57) ABSTRACT

An office-type chair includes a weight responsive mechanism having a front link pivotally connected between the base and the seat, a rear link pivotally connected between the seat and the backrest, and a resilient element, wherein the force of a user occupying the seat pivots the front link and the rear link against a resistance created by the resilient element an amount proportional to the weight of the user to increase the effective length of the moment arm between the user and the recline axis, such that the force to pivot the backrest about the recline axis varies as a function of the weight of the user. In one embodiment, a secondary recline spring between the base and the backrest, the secondary spring contributing to the biasing force of the recline tension spring when the backrest is moved to the reclined position.

20 Claims, 18 Drawing Sheets

(56) References Cited

U.S. PATENT DOCUMENTS 4,889,385 A 12/1989 Chadwick et al.
4,892,354 A 1/1990 Estkowski et al.
4,911,501 A 3/1990 Decker et al.
4,966,411 A 10/1990 Katagiri et al.
5,029,940 A 7/1991 Golynsky et al.
5,056,866 A 10/1991 Tobler
5,080,318 A 1/1992 Takamatsu et al.
5,224,758 A 7/1993 Takamatsu et al.
5,251,958 A * 10/1993 Roericht ..... A47C 1/03283 297/321
5,288,138 A 2/1994 Stulik et al.
5,333,368 A 8/1994 Kriener et al.
5,348,372 A 9/1994 Takamatsu
5,366,274 A * 11/1994 Roericht ..... A47C 1/03283 297/321
5,375,912 A 12/1994 Stulik et al.
5,397,165 A 3/1995 Grin et al.
5,486,035 A 1/1996 Koepke et al.
5,511,759 A 4/1996 DeKraker et al.
5,547,252 A 8/1996 Pfenniger
5,658,045 A 8/1997 Koolwijk et al.
5,660,439 A 8/1997 Unwalla
5,765,914 A 6/1998 Britain et al.
5,806,930 A 9/1998 Knoblock
5,909,924 A 6/1999 Roslund, Jr.
5,909,974 A 6/1999 Myung
5,918,935 A 7/1999 Stulik et al.
5,979,984 A 11/1999 DeKraker et al.
6,085,153 A 7/2000 Hirsh et al.
6,209,958 B1 4/2001 Thole
6,250,715 B1 6/2001 Caruso et al.
6,582,019 B2 6/2003 Nsalaco et al.
7,036,882 B2 5/2006 Elzenbeck
7,273,253 B2 9/2007 Deimen et al.
7,434,879 B2 * 10/2008 Ueda ..... A47C 7/4454 297/296 X
7,513,569 B2 4/2009 Curiger
7,549,701 B2 6/2009 Erker
7,585,028 B2 * 9/2009 Jenkins ..... A47C 7/004 297/302.3 X
7,600,814 B2 10/2009 Link
7,625,045 B2 12/2009 Hatcher et al.
7,784,870 B2 8/2010 Machael et al.
7,857,390 B2 * 12/2010 Schmitz ..... A47C 31/126 297/300.1
7,992,937 B2 8/2011 Plikat et al.
8,002,351 B2 * 8/2011 Golynsky ..... A47C 7/445 297/301.1
8,025,334 B2 * 9/2011 Schmitz ..... A47C 31/126 297/300.1
8,100,476 B2 * 1/2012 Jenkins ..... A47C 3/026 297/302.3 X
8,146,990 B2 4/2012 Bock
8,308,241 B2 * 11/2012 Jenkins ..... A47C 7/445 297/302.3 X
8,485,604 B2 7/2013 Pfeifer et al.
8,622,474 B2 * 1/2014 Jenkins ..... A47C 1/03279 297/300.4 X
8,702,171 B2 4/2014 van Hekken
8,967,724 B2 3/2015 Battey et al.
8,998,338 B2 4/2015 Vander Veen et al.
9,226,582 B2 * 1/2016 Jenkins ..... A47C 7/40
9,480,339 B2 11/2016 Cvek
9,504,331 B2 11/2016 Machael et al.
9,560,917 B2 2/2017 Roslund, Jr.
9,756,945 B2 * 9/2017 Jenkins ..... A47C 3/026
9,801,471 B2 10/2017 Machael et al.
9,839,292 B2 12/2017 Miller
9,867,468 B2 1/2018 Wu
10,021,979 B2 7/2018 Miller
10,021,984 B2 * 7/2018 Ludwig ..... A47C 7/54
10,165,861 B2 1/2019 Smith et al.
10,194,750 B2 * 2/2019 Ludwig ..... A47C 1/03277
10,213,021 B2 2/2019 Walters
10,238,215 B2 3/2019 Peterson et al.
10,299,595 B2 * 5/2019 Diffrient ..... A47C 3/026
10,321,763 B2 6/2019 Bonneywell
10,383,448 B1 8/2019 VerBeek et al.
10,485,346 B2 11/2019 Jones
10,575,648 B2 * 3/2020 Ludwig ..... A47C 1/03261
10,624,457 B2 4/2020 Schmitz et al.
11,096,497 B2 * 8/2021 Ludwig ..... A47C 3/20
11,259,637 B2 * 3/2022 Ludwig ..... A47C 3/20
11,324,325 B2 * 5/2022 Ludwig ..... A47C 1/03255
11,357,329 B2 * 6/2022 Deevers ..... A47C 1/0307
11,439,235 B2 9/2022 Taylor et al.
11,553,797 B2 * 1/2023 Ludwig ..... A47C 7/445
11,617,444 B2 * 4/2023 Deevers ..... A47C 1/03277 297/301.1
11,786,039 B2 * 10/2023 Deevers ..... A47C 3/021 297/301.1
11,805,913 B2 * 11/2023 Deevers ..... A47C 7/40
11,812,870 B2 * 11/2023 Deevers ..... A47C 7/441
11,963,621 B2 * 4/2024 Ludwig ..... A47C 5/12
12,161,232 B2 * 12/2024 Deevers ..... A47C 7/44
12,207,737 B2 * 1/2025 Deevers ..... A47C 7/4454
2002/0109384 A1 8/2002 Hansen
2003/0137171 A1 7/2003 Deimen et al.
2004/0195883 A1 10/2004 Vrijlandt et al.
2004/0245827 A1 12/2004 Bedford et al.
2006/0006715 A1 1/2006 Chadwick et al.
2006/0202530 A1 9/2006 Lin
2007/0001497 A1 1/2007 Diffrient
2008/0088163 A1 4/2008 Sander et al.
2009/0079238 A1 3/2009 Plikat et al.
2009/0146476 A1 6/2009 Kan et al.
2010/0141002 A1 6/2010 Kurrasch et al.
2010/0301531 A1 12/2010 Delahousse et al.
2012/0025576 A1 2/2012 Stern et al.
2012/0099831 A1 4/2012 Cartis et al.
2013/0169017 A1 7/2013 Masunaga et al.
2015/0123441 A1 5/2015 Duke
2016/0100691 A1 4/2016 Masunaga et al.
2016/0227935 A1 8/2016 DeJule et al.
2022/0273103 A1 9/2022 Gilchrist et al.
2024/0237826 A1 * 7/2024 Ludwig ..... A47C 3/22
2025/0151912 A1 * 5/2025 Ludwig ..... A47C 7/445
2025/0204687 A1 * 6/2025 Deevers ..... A47C 7/4454

FOREIGN PATENT DOCUMENTS

DE 102013005861 A1 10/2014
EP 2769642 8/2014
EP 3253254 8/2022
JP H0231530 2/1990
WO 2007012391 2/2007
WO 2007110732 A2 10/2007
WO 2008020824 A2 2/2008
WO 2020010468 A1 1/2020
WO 2022018644 A1 1/2022
WO 2022187667 A1 9/2022

* cited by examiner

WEIGHT RESPONSIVE CHAIR

BACKGROUND OF THE INVENTION

The present invention relates to a weight responsive office chair, and more particularly, to an office chair having an improved weight-activated mechanism for controlling the tilting and recline of a seat and back of the chair.

Recline tension mechanisms are used to control tilting of a seat and back assembly for the chair. More particularly, these mechanisms are used to control the degree of force required for an occupant to rotate the backrest with respect to the seat. In some chair constructions, the entire rearward tilting force of a seat back assembly is controlled by one or more springs that resist the entire load generated by the seat and back assembly. The tension on the springs may be adjusted to change the recline resistance.

Weight responsive mechanisms provide a degree of adjustment to the recline resistance based on the weight of the occupant. In a common weight responsive mechanism, the back is connected to a rear portion of the seat such that rearward tilting of the back essentially effects lifting of the seat wherein the weight of the occupant on the seat opposes such lifting, and therefore, serves to counterbalance much of the tilting forces being applied directly to the back. These tilting forces applied to the back are transferred to the seat by an intermediate link so that the weight of the occupant is used to resist the rearward tilt forces. While a tilt mechanism having a spring may also be provided for additional resistance and for returning the backrest to an upright position, the spring capacity of this weight responsive mechanism is substantially lower due to the assistance provided by the occupant's body weight in resisting tilting of the back assembly.

In some cases, the common weight responsive mechanisms suffer in that they cannot accommodate a wide range of occupant types. Ideally, users in the $5^{th}$ to $95^{th}$ percentile of weight ranges would have the same back support resistance experience in the chair, but common weight responsive mechanisms often provide drastically different experiences for those at the ends of the weight spectrum. As a result of the direct relationship between the occupant's weight and the recline force, a chair that provides comfortable and effective recline for a generally lighter occupant may not provide sufficient support for a generally heavier occupant, and conversely a chair that provides comfort and effective recline for a heavier occupant may require too much force for a lighter occupant to recline.

SUMMARY OF THE INVENTION

The present invention provides an office-type chair with a weight responsive mechanism that extends the range of accommodation for weight proportional occupant support.

In one embodiment, the office-type chair includes a weight responsive mechanism connected between the seat and the base, wherein the weight responsive mechanism includes a front link pivotally connected between the base and the seat, a rear link pivotally connected between the seat and the backrest, and a weight responsive biasing component, such as a spring or a resilient material, supporting the seat, wherein the force of a user occupying the seat acts against the biasing component to pivot the front link and the rear link an amount proportional to the weight of the user to increase the effective length and efficiency of the moment arm between the user and the recline axis, such that the force to pivot the backrest about the recline axis varies as a function of the weight of the user. The rear link may include an upper rear link and a lower rear link, with the backrest extending from the lower rear link, wherein the biasing component biases the seat and links at a first position.

In one embodiment, the office-type chair further includes a secondary recline spring between the base and the backrest. The secondary spring contributes to the biasing force of the recline tension spring when the backrest is moved to the reclined position (i.e., the recline resistance). The secondary spring may be fixed in position, or may otherwise be manually or dynamically adjustable. The secondary spring may be unloaded when the backrest is in the upright position to enable easy adjustment of the secondary spring when the chair is in the upright position. In an embodiment wherein the secondary spring is dynamically adjustable, the secondary spring can function as a supplemental weight responsive mechanism.

The secondary spring may be a compression coil spring having a first end and a second end, the first end fixed in position on the base, the second end adjustably positioned on the backrest, wherein adjustment of the second end of the secondary spring changes the amount of contribution of the secondary spring to the recline resistance. In an embodiment where the secondary spring is dynamically adjustable, the secondary spring may automatically adjust as a function of the weight of the user. In one embodiment, this dynamic adjustment is provided by a drive linkage connected between the seat and the second end of the secondary spring, wherein movement of the seat causes movement of the second end of the spring. In another embodiment, the backrest includes a system for retaining the second end of the spring during recline, which may include the second end of the spring having an indexer that is retained in place by an index surface when the backrest is reclined.

The weight sensing biasing component may be a weight sensing spring that supports the seat and biases the seat in a first position. The weight sensing spring may be a resilient material, and in one embodiment the weight sensing spring is a resilient material that is coextensive with the upper rear link. The resilient material may be capable of flexing as the upper rear link moves from the first position to a forward position upon the force of the weight of a user sitting on the seat. Although a variety of spring types may be used, in one embodiment, the weight sensing spring is a one-piece, V-shaped resilient member having a first leg that extends between the seat and the seat pivot axis and a second leg that extends from the seat pivot axis to the backrest.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and may be practiced or may be carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

Figure 1:
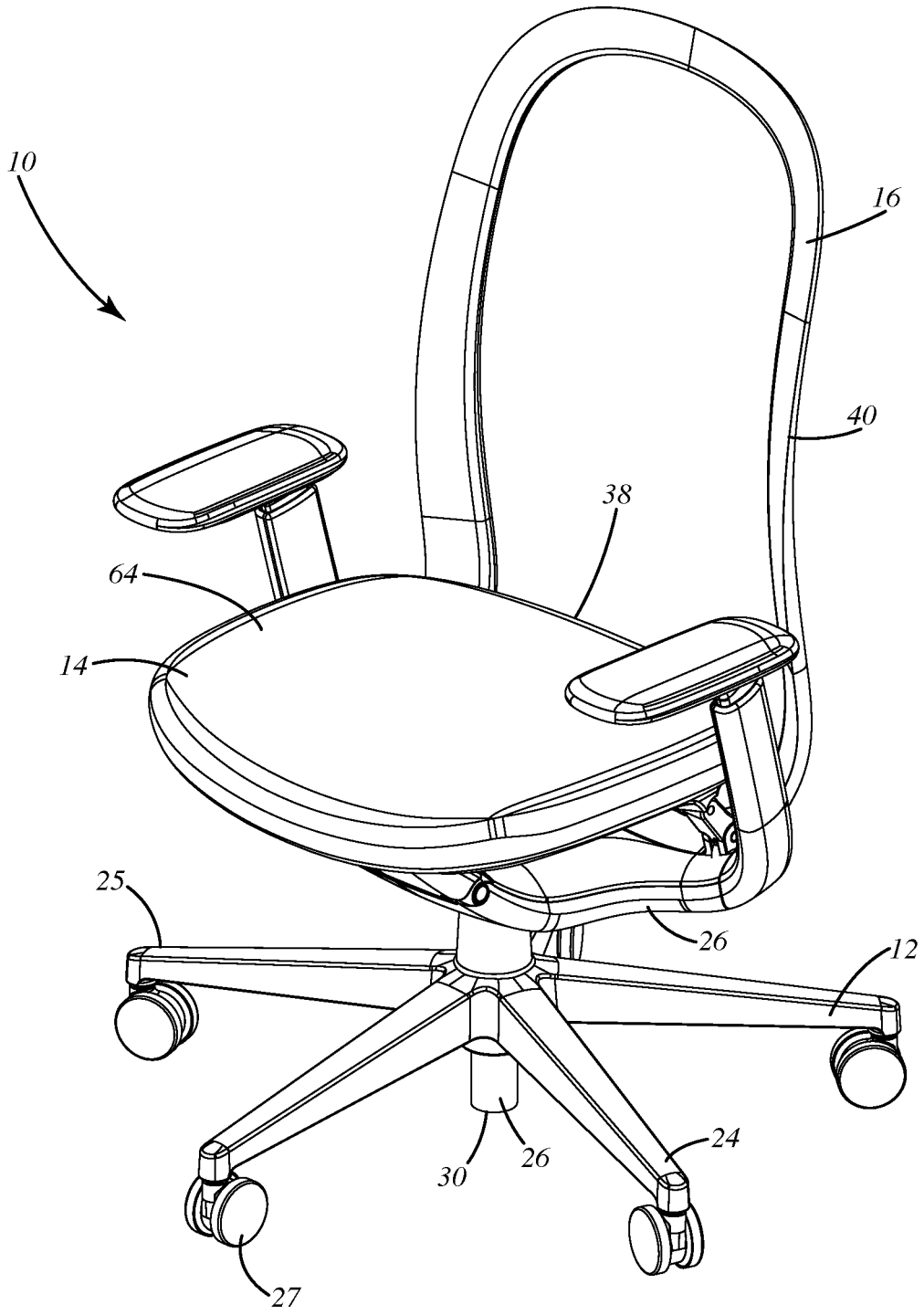
FIG. 1 is a perspective view of a chair according to one embodiment of the present invention.

An embodiment of an office-type chair having a weight sensing, or weight responsive, recline mechanism is shown in the Figs. and generally designated 10. As shown, the chair 10 includes a base 12, a seat 14, and a backrest 16. The backrest 16 is pivotally mounted to the base 12 at a recline axis 18. A weight sensing mechanism 20 is connected to the base 12 and the backrest 16 to enable a dynamic change in the force required to pivot the backrest 16 about the recline axis 18 as a function of the weight of the occupant sitting on the seat 14, and the corresponding force F exerted on the seat 14 by the occupant.

Figure 3:
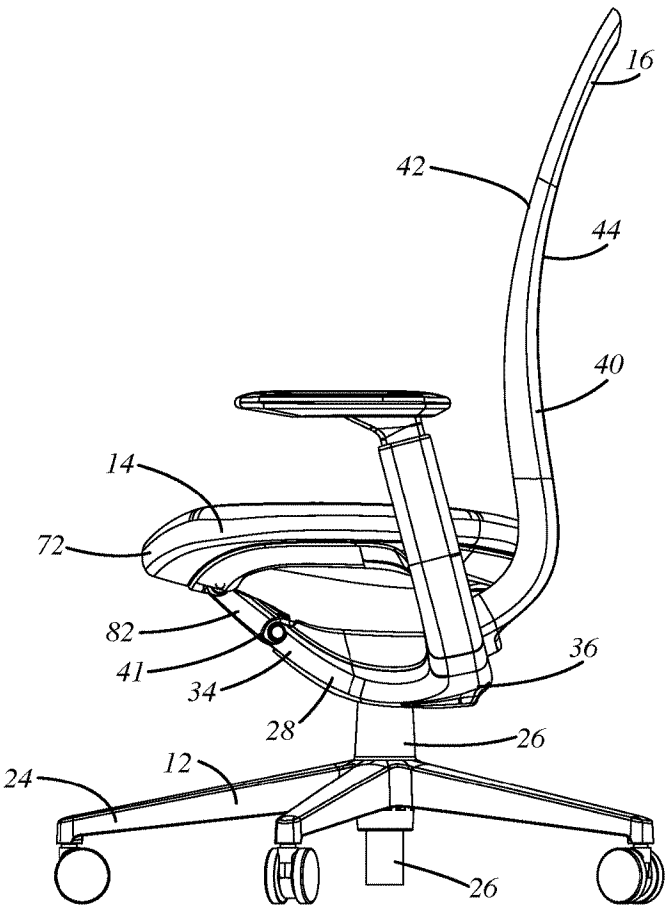
FIG. 3 is a side view thereof.

The base 12 generally includes a ground engaging support 24, a pedestal 26 extending upwardly from the ground engaging support 24, and a mechanism portion 28 supported on the pedestal 26. The ground engaging portion 24 may be one of a variety of types of ground engaging supports for office type chairs. For example, the ground engaging support 24 may include a flat portion that is intended to be stationary on the ground, or, as referenced in FIG. 1, may alternatively include a series of arms 25 supported on casters 27 for enabling rolling of the office-type chair 10 along the ground. The pedestal 26 extends upwardly from the ground engaging support 24 from a lower end 30 of the pedestal 26 to an upper end 32. In one embodiment, the pedestal 26 is a telescoping cylinder that provides a degree of height adjustment. The pedestal 26 may also enable swiveling rotation of the seat 14 with respect to the ground engaging portion 24. In the illustrated embodiment, the mechanism portion 28 of the base 12 is mounted at the upper end 32 of the pedestal 26. Referring to FIG. 3, the mechanism portion 28 includes a horizontal extent with a forward edge 34 and a rearward edge 36 opposite the forward edge 34. As described in more detail below, the mechanism portion 28 supports the seat 14, backrest 16 and weight sensing mechanism 20.

The backrest 16 includes an upright portion 40 positioned adjacent a rear edge 38 of the seat 14 and the backrest 16 includes a forward surface 42 for engaging the back of the occupant, and a rear surface 44 opposite the forward surface 42. As illustrated, for example, in FIG. 5, the backrest 16 includes a perimeter frame having a cross member 46 forming a lower edge of the upright portion 40. As described in more detail below, the cross member 46 may support a lower rear link portion 50 of the weight sensing mechanism 20. The upright portion 40 may vary from chair to chair. For example, in some applications the upright portion 40 may include a perimeter frame that supports a load bearing material held in tension on the frame. In another example, the frame may be a shell, which may support a cushion material and which may be upholstered.

Figure 6:
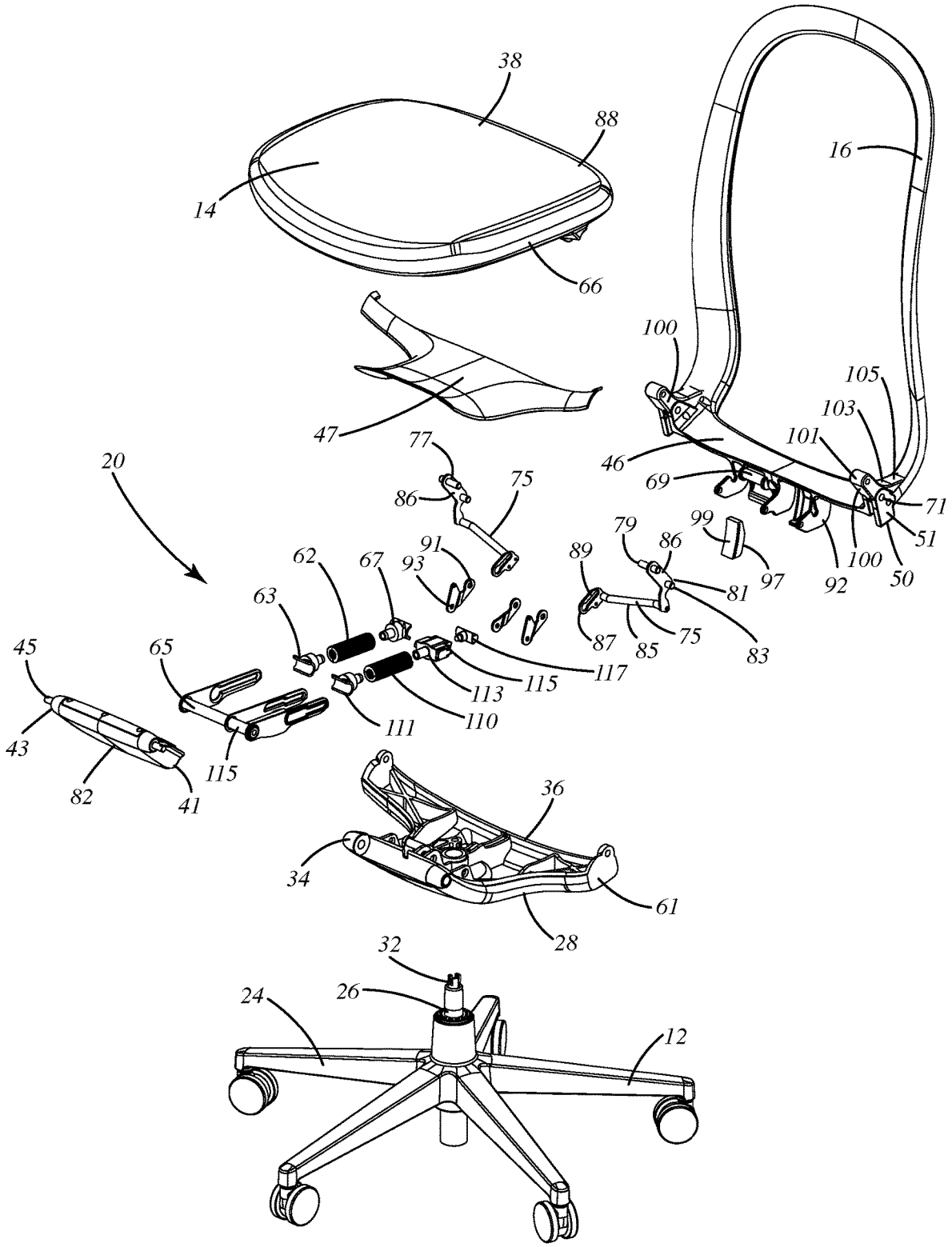
FIG. 6 is an exploded view of a portion of the chair according to one embodiment.

In one embodiment, the backrest 16 is pivotally mounted to the base 12 at the recline axis 18, and with reference to FIG. 6, the lower rear link 50 on the backrest 16 is pivotally mounted proximate to the rearward edge 36 of the mechanism portion 28 of the base 12 via a pivot connection such as a pin 60 extending through the lower rear link 50 on the backrest 16 and a pivot pin flange 61 extending from the base 12 near the rearward edge 36 and forming the recline axis 18 about which the backrest 16 can pivot with respect to the base 12. The backrest 16 may additionally include a primary recline tension spring 62 between the backrest 16 and the base 12, with the recline tension spring 62 biasing the backrest 16 in an upright position (such as the position shown in FIG. 3) with respect to the base 12. As an occupant sitting on the chair 10 exerts a rearward force on the backrest 16, the occupant acts against the recline tension spring 62 to move the backrest 16 to a reclined position (such as the reclined position shown in FIGS. 10-12). The recline tension spring 62 may be one or more of a variety of springs between the base 12 and the backrest 16, and in the illustrated embodiment the recline tension spring 62 is a coil spring positioned on the mechanism housing 28 and extending in a fore/aft direction with a first end coupler 63 coupled to a forward coupler rod 65 attached to the base 12 and a second end coupler 67 coupled to a rear coupler rod 69 on the backrest 16. In another embodiment, the primary recline spring may be a torsion spring or another type of spring or resilient element capable of biasing the backrest 16 in the upright position.

Figure 2:
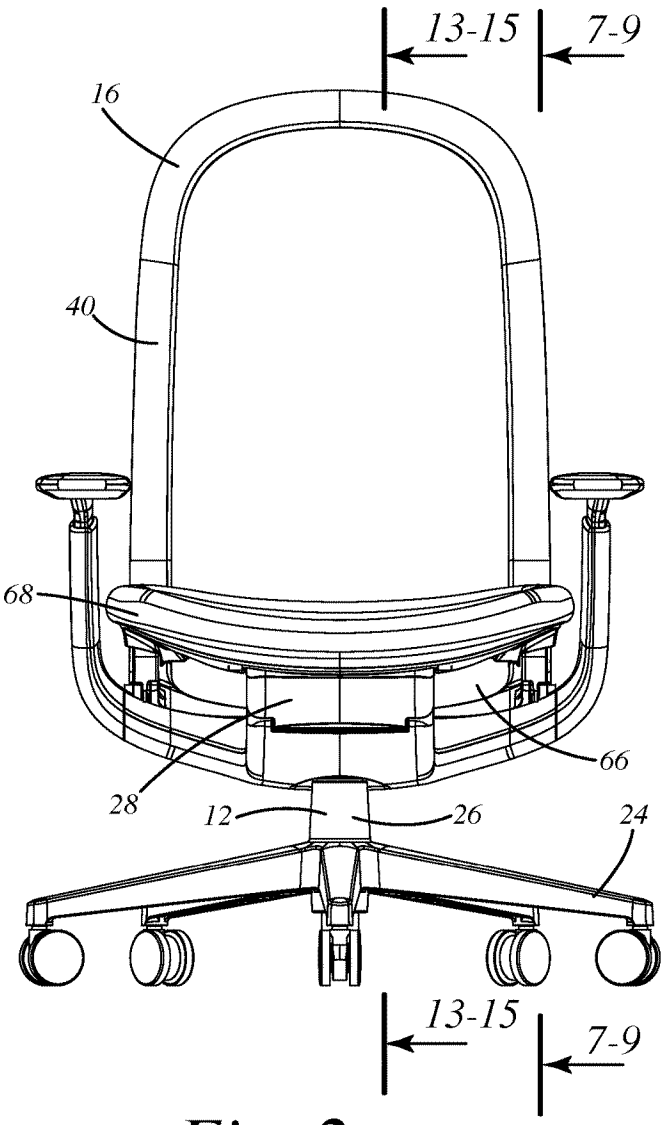
FIG. 2 is a front view thereof.
Figure 4:
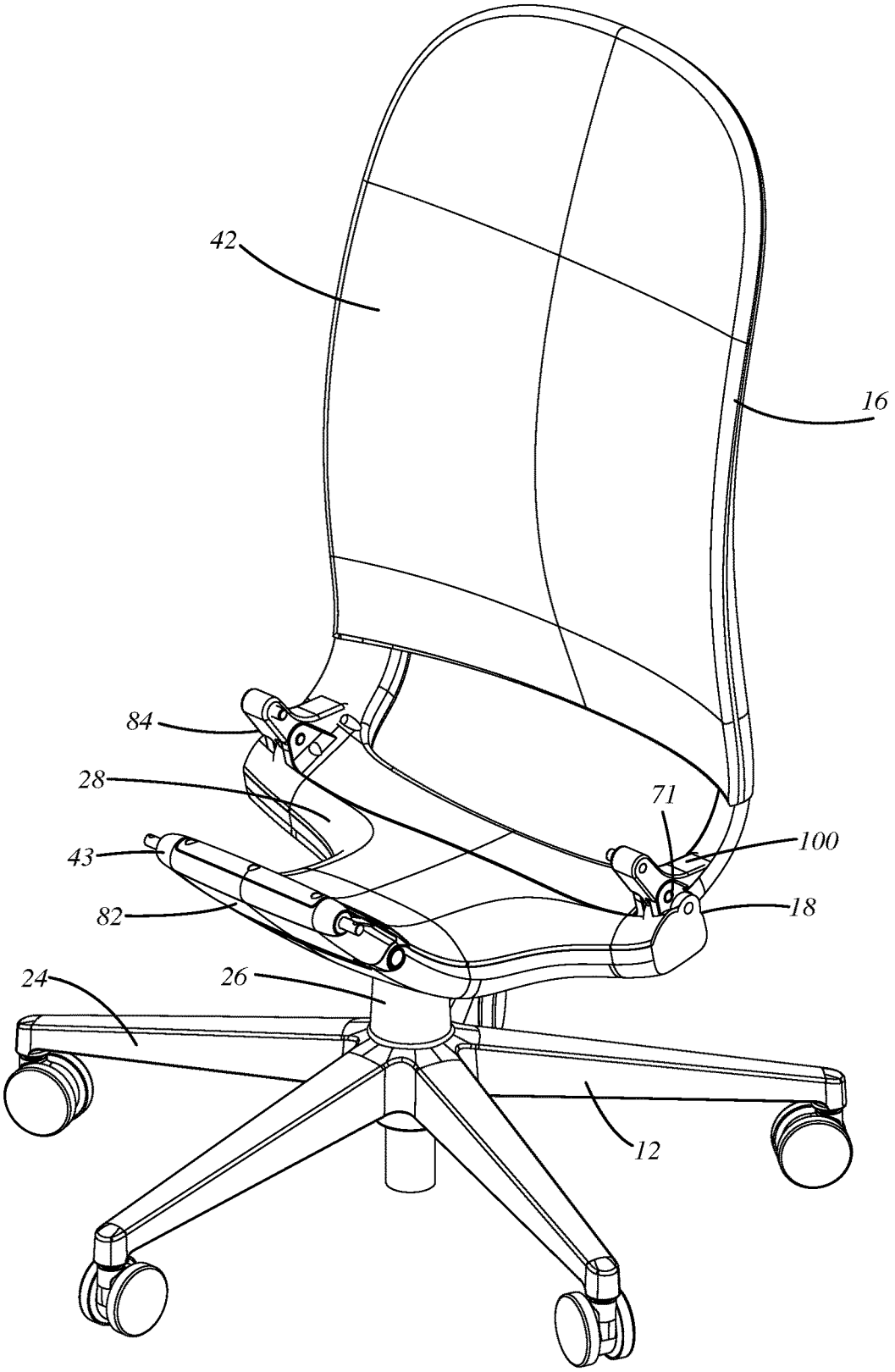
FIG. 4 is a perspective view of the chair with the seat removed.

With reference to FIGS. 1-3, the seat 14 generally includes a horizontally extending upper surface 64 for supporting an occupant. In one embodiment, the seat 14 includes a lower support surface 66. The lower support surface 66 may include a shell or seat pan for supporting a cushion 68 that extends upwardly to form the upper surface 64. Other seat support embodiments may also be used, such as a load bearing fabric supported in tension by a perimeter frame. In the illustrated embodiment, the seat 14 forms an upper link of a four-bar linkage used in connection with the weight sensing mechanism 20. The seat 14 further includes a forward edge 72 opposite the rearward edge 38, with the rearward edge 38 facing the backrest 16. The seat 14 defines a longitudinal extent and fore/aft direction between the forward 72 and rearward 38 edges.

The weight sensing mechanism 20 is supported on the base 12 and connected between the base 12, the seat 14 and the backrest 16 and designed to change the amount of recline resistance as a function of the weight of the occupant (i.e., as a function of the downward force F exerted on the seat 14 by the occupant). As the weight of the occupant increases, the weight sensing mechanism 20 causes the force required to move the backrest 16 to the reclined position to increase. The weight sensing mechanism 20 functions by changing the effective length of the moment arm between the seat 14 and the recline axis 18. As the weight of the occupant increases, the seat 14 is shifted in the longitudinal direction away from the backrest 16, thereby increasing the moment arm and the effective force required to recline the backrest 16.

In the illustrated embodiment, the weight sensing mechanism 20 operates via a four-bar linkage connected between the base 12, seat 14 and backrest 16. More particularly, the four-bar linkage includes an upper link formed by the seat 14, a bottom link formed by the mechanism portion of the base 28, a front link 82, and a rear link 84. The front link 82 is pivotally connected between the lower surface 66 of the seat 14 adjacent to the forward edge 72, and the forward edge 34 of the mechanism portion of the base 28. As illustrated, the front link 82 includes a lower edge 41 pivotally connected to the forward edge 34 of the mechanism portion 28, and the front link 82 has an upper edge 43 pivotally connected to the forward edge 72 of the lower surface 66 of the seat 14 via opposing front pivot pins 45 extending into mating receptacles on the seat 14, although other pivotable connection may be utilized. In the illustrated embodiment, the front link 82 is a single link 82 extending laterally across substantially all of the forward edge 34 of the mechanism portion 28, but in an alternative embodiment, the front link 82 may be formed from two or more similar link elements that are spaced apart laterally along the forward edge 34. With reference to FIG. 6, the weight sensing mechanism 20 may be enclosed between the mechanism portion 28 of the base 12 and a cover 47.

In the illustrated embodiment, the rear link 84 includes both an upper rear link 86 and the lower rear link 50. As noted above, the lower rear link 50 extends from the backrest 16 and is fixed to the backrest 16. The lower rear link 50 includes an upstanding sidewall 51 that defines a seat pivot axis hole 71 and a recline axis hole 73 spaced from the seat pivot axis hole 71. The upper rear link 86 connects between the lower rear link 50 and the seat 14, and with reference to FIG. 6, in one embodiment the upper rear link 86 forms a portion of a drive linkage bracket 75, wherein the upper link 86 includes a first end 77 supporting a seat attachment pin 79 and a second end 81 supporting a seat pivot pin 83. A drive linkage arm 85 extends from the second end 81 as described in more detail below. In one embodiment, the upper rear link 86 is pivotally connected to the lower rear link 50 via the seat pivot pin 83 extending through the seat pivot axis hole 71. The seat attachment pin 79 may be fixed to the upper rear link 86, or otherwise fixed to the lower rear link 50 or may be a separate element extending through both links 86, 50. The upper rear link 86 is pivotally connected to the rear edge 88 of the lower surface 66 of the seat 14 by the insertion of the seat attachment pin 79 into a receptacle on the seat 14. Although described singularly as a rear link 84, in the illustrated embodiment, the rear link 84 includes a pair of the rear links 84 and drive linkage brackets 75 spaced apart laterally on opposite sides of the seat 14. In another embodiment, the chair 10 may include only a single rear link 84, or multiple spaced apart rear links 84. In an alternative embodiment, the rear links 84 may each be a single link member instead of being broken into upper and lower link members, wherein the rear link would connect directly to the backrest 16 and the base 12 at a recline axis.

With the base 12 fixed in position, the front link 82 and rear link 84 are pivotable between a generally upright position and a generally forward position, wherein in the forward position the seat 14 is shifted longitudinally forward, in a direction away from the backrest 16. In one embodiment, the weight sensing mechanism 20 includes a weight sensing spring element 100 (or a pair of weight sensing spring elements 100) that biases the links 82, 84 and the seat 14 in the generally upright positions, and provides a degree of resistance to the movement of the seat 14 and links 82, 84 to the forward positions. In the illustrated embodiment, the weight sensing spring element is a pair of resilient elements 100 that provide a degree of resistance to a force exerted on the seat and that biases the weight sensing mechanism 20 in the upright position when the seat 14 is not loaded. As shown, the resilient elements 100 are attached to the rear links 84 and bias the rear links 84 in an upright position as shown in FIG. 6. The resilient elements 100 are formed from a resilient material, such as a thermoplastic elastomer, with characteristics that enable the resilient material to deform, and thus the links 82, 84 to pivot a desired amount according to a desired deflection profile for a range of occupant weights.

Referring to FIG. 6, and FIGS. 16-23, in one embodiment, each resilient element 100 is a V-shaped member having a first leg 101, a base 103, and a second leg 105. The first leg 101 is generally coextensive with the upper rear link 86, and as illustrated is fixed to move with the upper rear link 86 via the pin 79 extending through both the upper rear link 86 and a receptacle 107 in the first leg 101 of the resilient element 100, and the pin 81 extending through both the upper rear link 86 and a receptacle 109 in the base 103 of the resilient element 100. The second leg 105 of the resilient element 100 extends from the base 103 to the backrest 16 and may be pivotally attached to the backrest 16, for example, with a receptacle 111, or fixedly attached to the backrest 16. The weight sensing spring 100 provides a resistance to movement of the seat 14 as a force or weight from an occupant is applied to the seat 14, and the weight sensing spring 100 may be constructed such that it does not flex until a predetermined force F on the seat 14 is exceeded. In the illustrated embodiment, when a force F greater than the predetermined threshold force is applied to the seat 14, the weight sensing spring(s) 100 flex by way of the second leg 105 bending or bowing as the first leg 103 is pivoted forward. In another embodiment, the first leg 103 may be configured such that the first leg 103 itself forms the upper rear link 86. In another embodiment, the weight sensing spring may be positioned adjacent to the front link 82, or elsewhere with respect to the weight sensing mechanism 20, and arranged to provide the desired resistance force on the weight sensing mechanism 20.

The downward weight or force F of the occupant on the seat 14 thus acts against the weight sensing spring 100 to pivot the front link 82 and upper rear link 86 forward and shift the seat 14 in an arc-shaped path and in a generally forward direction with the seat 14 moving from the upright position and in a direction both away from the backrest and downwardly. With respect to the resilient element 100, as the force F exceeds the threshold, the second leg 105 of the resilient element 100 is flexed as the first leg 101 is pivoted forward. An occupant having a weight below the predetermined threshold may sit on the seat 14 without any movement of the seat 14 or weight sensing mechanism 20. An occupant 22 of lesser weight, but above the threshold, will act against the spring 100 to shift the seat 14 forward a first distance and cause the second leg 105 of the resilient element 100 to flex. An occupant of greater weight will act against the spring 100 to shift the seat 14 forward a second distance that is greater than the first distance. The greater the longitudinal movement of the seat 14, the greater the effective length of the moment arm between the occupant 22 and the recline axis 18, and the greater the force required to pivot the backrest 16 about the recline axis 18. The effect of this variation in seat 14 movement as a function of the occupant's weight thus varies the amount of force required to move the backrest 16 to the reclined position as a function of the occupant's weight.

The chair 10 may additionally include a secondary, or supplemental recline spring 110. FIG. 6 shows the details of the secondary spring 110 according to one embodiment wherein the secondary spring 110 is a tension coil spring that includes a forward end coupler 111 and a rearward end coupler 113. The forward end 111 is pivotally connected to a coupler bracket 115, which may extend from and be coaxial with the coupler rod 65 and is mounted at the forward edge 34 of the mechanism housing 28. The rearward end coupler 113 includes an end slider 117 connected to an indexer 119 that forms the distal second end 113 of the spring 110. As illustrated, the end slider 117 forms opposing lateral projections that each extend into a slot 123 defined within a slide bracket 125 connected to the coupler bracket 115.

Figure 5:
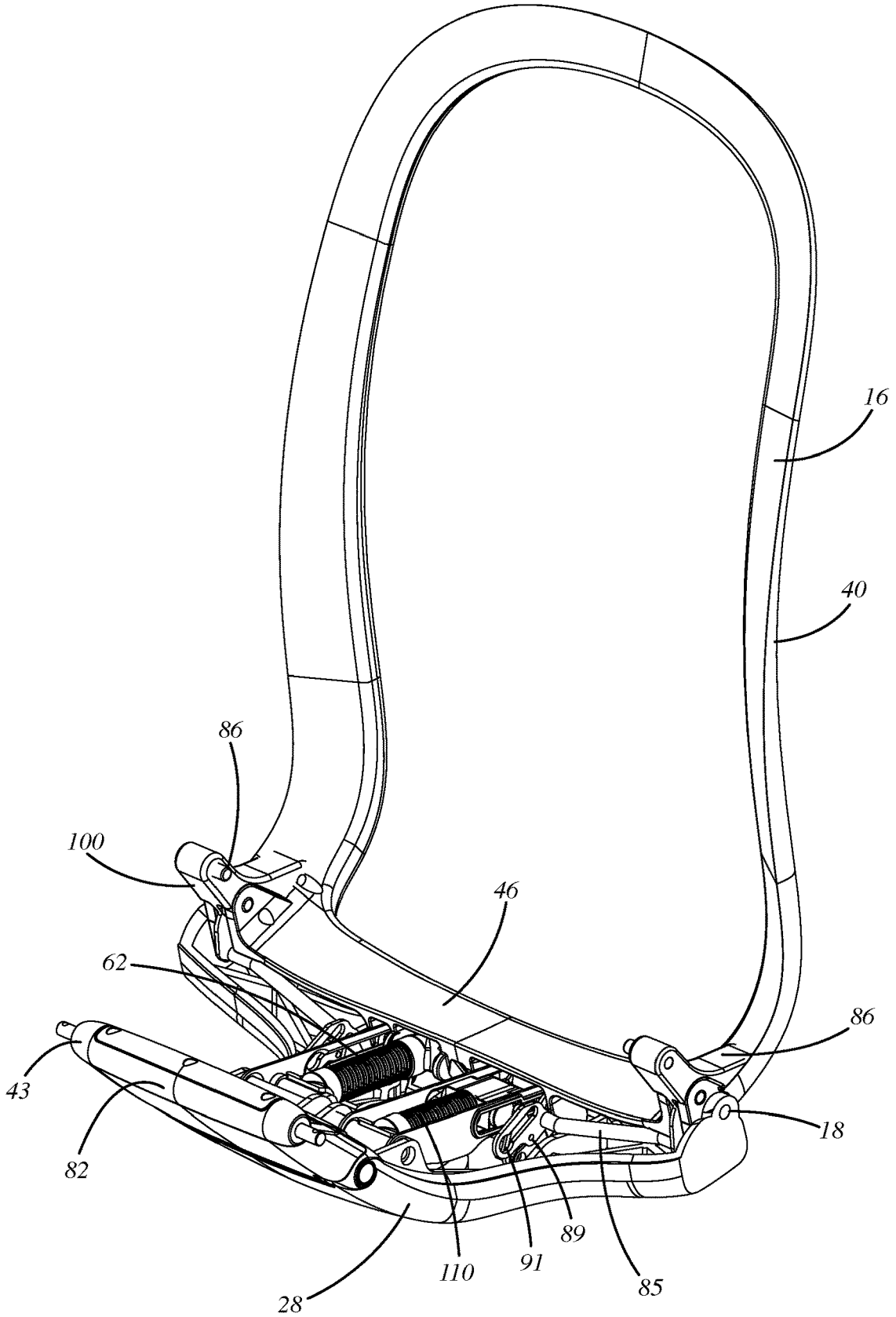
FIG. 5 is a perspective view of the backrest and the mechanism.

In one embodiment, the secondary recline spring 110 can function as a secondary weight sensing mechanism via a connection with the seat that dynamically adjusts the angle of the secondary spring 110 as a function of the user's weight. More particularly, the secondary spring 110 can be driven to pivot about the coupler bracket 115 such that the rearward end 113 moves up and down, thereby changing the effective force of the spring 110. In one embodiment, this spring 110 is connected between the base 12 and the weight sensing mechanism 20 and extends generally parallel to the primary recline spring 62 when the seat 14 is not occupied. The secondary spring 110 contributes to the force of the recline tension spring 62, and in one embodiment, the secondary spring 110 is generally unloaded when the backrest 16 is in the upright position, such that it is primarily only loaded upon the occupant moving the backrest 16 to the reclined position. With reference to FIGS. 5 and 6, the second end 113 of the secondary spring 110 may be connected to the drive linkage arms 85 of the two drive linkage brackets 75. In one embodiment, each drive linkage arm 85 extends downwardly from the upper rear link 86 and is connected to the upper rear link 86 such that pivoting of the upper rear link 86 causes pivoting of the drive linkage arm 85. As illustrated, each drive linkage arm 85 is an elongated arm extending from the upper rear link 86 and including a distal end 87 defining a slot 89. The slot 89 receives a pin 91 extending from an auto adjustment linkage 93, which is pivotally connected to the end slider 113 on the second end of the secondary spring 110. Pivoting of the upper rear link 86 thus causes downward pivoting of the drive linkage arm 85, driving the auto adjustment linkage 93 in a downward direction, and therefore driving the end slider 113 in a downward direction. As a result of the linkage connection between the opposing lateral projections 115 of the end slider 113 on the second end of the secondary spring 110 within the slot 123 on slide bracket 125, the downward movement of the drive linkage arm 85 causes downward movement of the second end 113 of the secondary spring 110 as the spring 110 pivots about the coupler bracket 115. In the illustrated embodiment, this pivoting causes the second end 113 of the secondary spring 110 to move in an arc shape, however, other linkage style connections and other connections between the secondary spring 110 and the seat 114 may alternatively be used.

In one embodiment, the chair 10 includes an indexer system that acts to allow free and dynamic movement of the secondary spring 110 when the backrest 16 is in an upright position, while retaining or "locking" the angular position of the secondary spring 110 when the backrest 16 is reclined. The indexer system generally includes the indexer 117, which forms the distal second end 113 of the secondary spring 110, and an indexer block 97 mounted to the backrest 16. More particularly, the indexer block 97 may be a block of compliant material having a forward indexer surface 99 facing the indexer 119. The indexer block 97 may be mounted to the backrest 16, and in one embodiment may be mounted on a support member 92 extending downwardly from the cross member 46 of the backrest 16. The indexer surface 99 may include a series of recesses or detents spaced vertically apart along the surface 99, with each detent forming a different lock position for the indexer 119. The indexer surface 99 is spaced from the indexer 119 when the backrest 16 is in the upright position, and the indexer block 97 pivots forward toward the indexer 119 as the backrest 16 is reclined about the recline axis 18 to move the indexer surface 99 into abutting engagement with the indexer 119 with the indexer 119 being at least partially inserted into one of the detents to retain the indexer 119 in place with respect to the indexer surface 99 for as long as the backrest 16 remains in the reclined position. As a result of the indexer block 97 being formed from a compliant material, such as TPE, the indexer 119 may engage with one of the detents on the index surface 99 without the user experiencing a noticeable click or snap into place. As described in more detail below, the basic function of the indexer system is to enable the angle of the secondary spring 110 to be automatically pivoted downward an amount corresponding to the weight of the user when the backrest is in the upright position, and then lock into place on the indexer surface 99 when the user reclines so as to prevent the position of the secondary spring 110 from suddenly changing when the user is in a reclined position.

In operation, the chair 10 functions to vary the amount of recline resistance on the backrest 16 as a function of the force on the seat 14. Put another way, the chair functions such that an occupant on the seat of a greater weight will experience a greater resistance to recline than an occupant of lesser weight. This function is provided by the weight sensing mechanism 20, and also by the secondary spring 110. Each of these mechanisms may function as a standalone mechanism for varying the recline resistance, and in the illustrated embodiment function together to vary the recline resistance.

Notably, and aside from the weight sensing mechanisms, the backrest 16 can recline with respect to the seat 14 about the recline axis 18. With reference to FIGS. 1 and 3, the recline axis 18 is formed at a pivotable connection via pin 60 extending between the lower rear link 50 on the backrest 16 and the pivot pin flange 61 on the base 12. The backrest 16 is maintained in an upright position as shown in FIGS. 5 and 7-9 by the primary recline spring 62 with first end 63 coupled to coupler rod 65 and second end 67 coupled to rear coupler rod 69 such that the spring 62 acts to urge the backrest 16 into the upright position and provide a first level of generally constant recline resistance.

The weight sensing mechanism 20 acts to vary the recline resistance as a function of the occupant's weight (i.e., as a function of the amount of force F applied to the seat 14). This mechanism 20 operates by the four-bar linkage formed between the seat 14, the mechanism portion 28 of the base 12, the front link 82 and the rear link 84, which supports the seat 14 and causes the seat 14 to move in an arc-shaped path. The seat 14 is generally movable along the path between a first, raised or upright position in which the seat is not occupied or occupied by a weight that is less than a predetermined threshold, and a second, forward and lowered position in which the seat 14 is occupied by a user with a weight greater than the predetermined threshold. In the second position, the seat 14 is forward, away from the backrest 16 and recline axis 18, and downward below the first position. The weight sensing spring 100 acts to hold the seat 14 and links 82, 84 in the first position. In the illustrated embodiment, shown in FIGS. 6-15, the spring 100 is formed from a resilient material that flexes when the force F on the seat 14 reaches the predetermined threshold. When the seat 14 is occupied with a weight greater than the predetermined threshold, the second leg 103 of the V-shaped resilient spring 100 flexes by bowing between its end points, and the first leg 101 pivots with the upper rear link 86.

Figure 7:
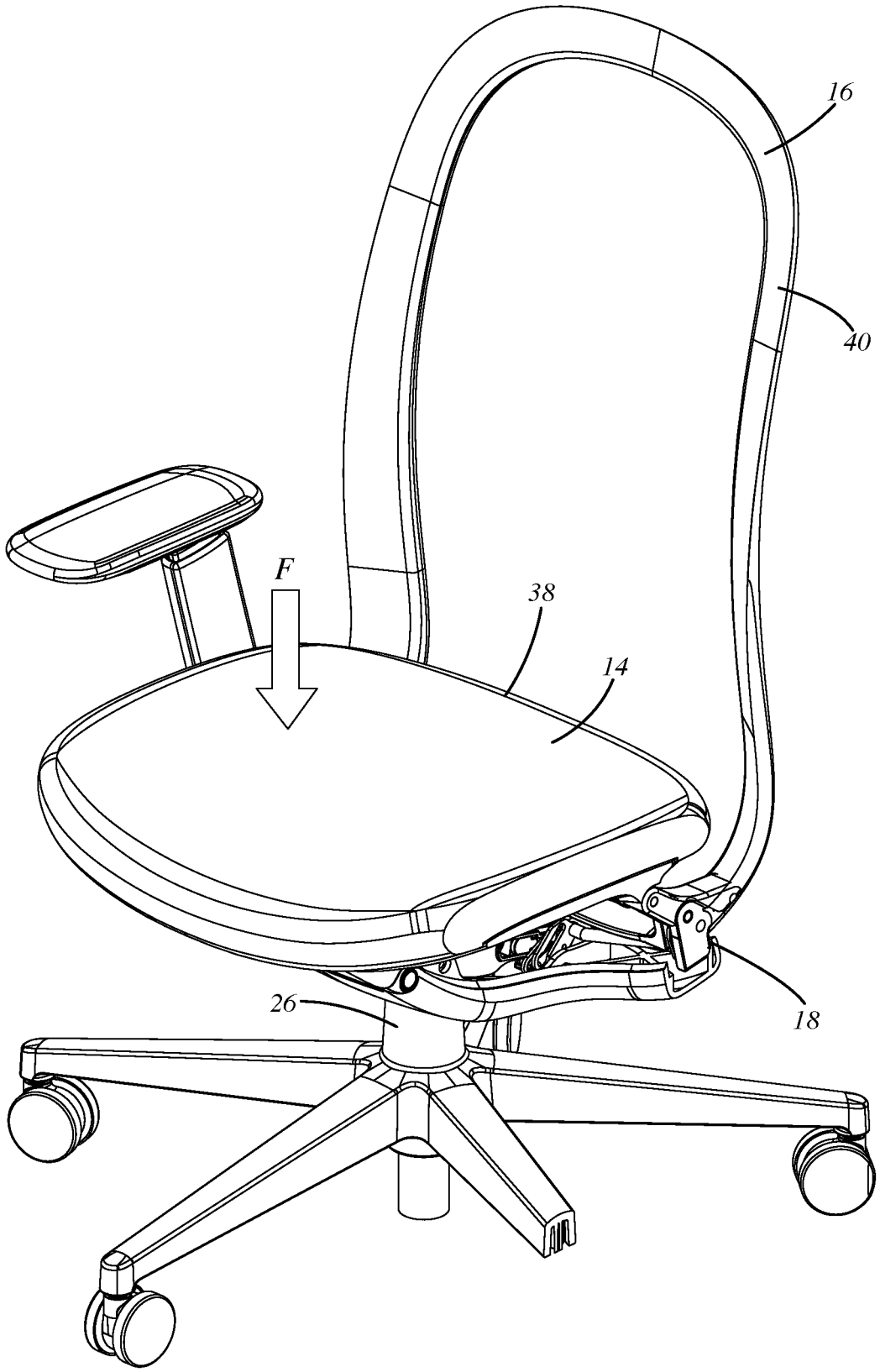
FIG. 7 is a perspective cross sectional view of the chair taken along line 7-9 in FIG. 2, wherein the backrest is in an upright position and the seat is provided with a force exemplary of an occupant with a weight in the $50^{th}$ percentile.
Figure 8:
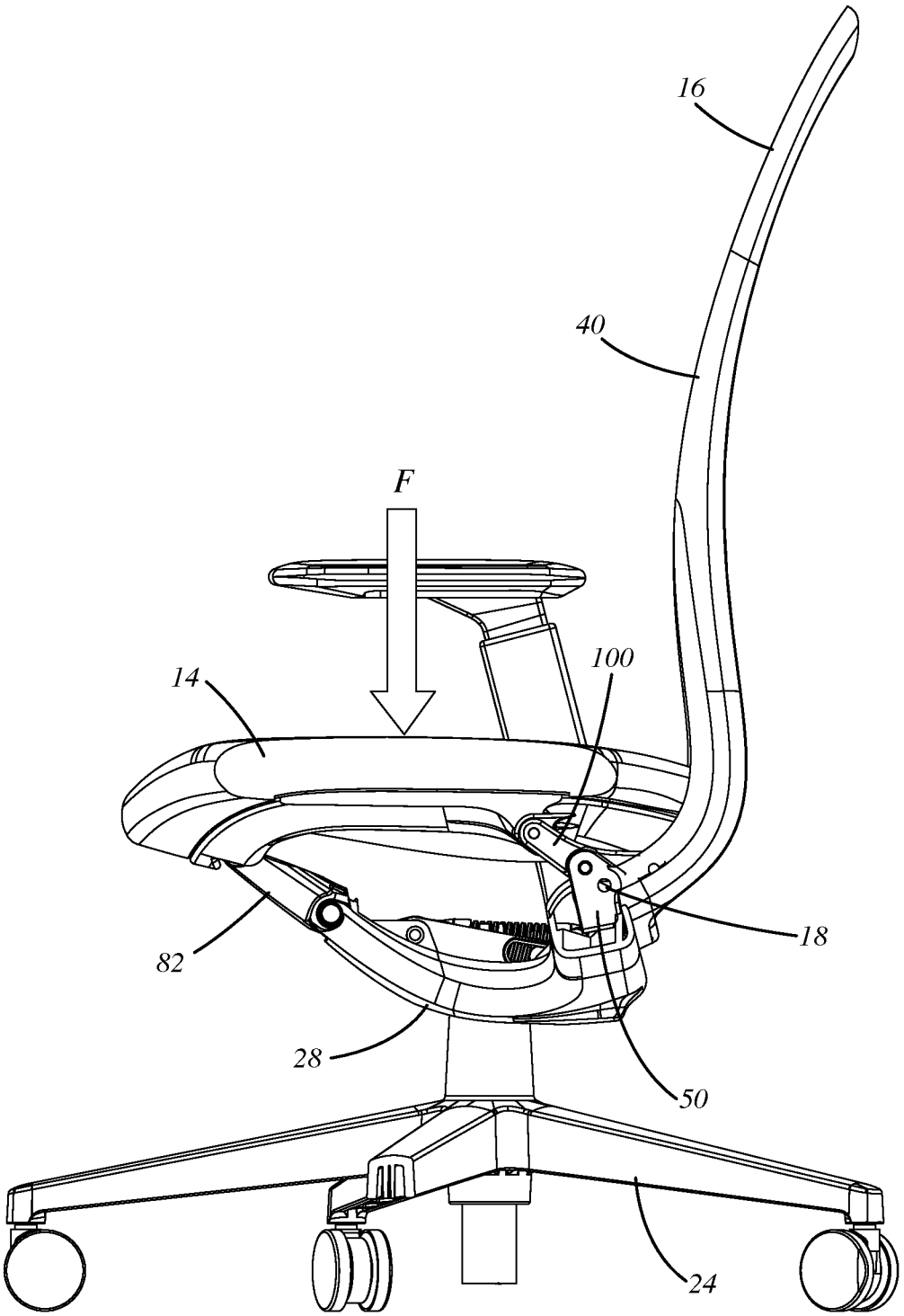
FIG. 8 is a side cross sectional view of the chair taken along line 7-9 in FIG. 2, wherein the backrest is in an upright position and the seat is provided with a force exemplary of an occupant with a weight in the $50^{th}$ percentile.
Figure 9:
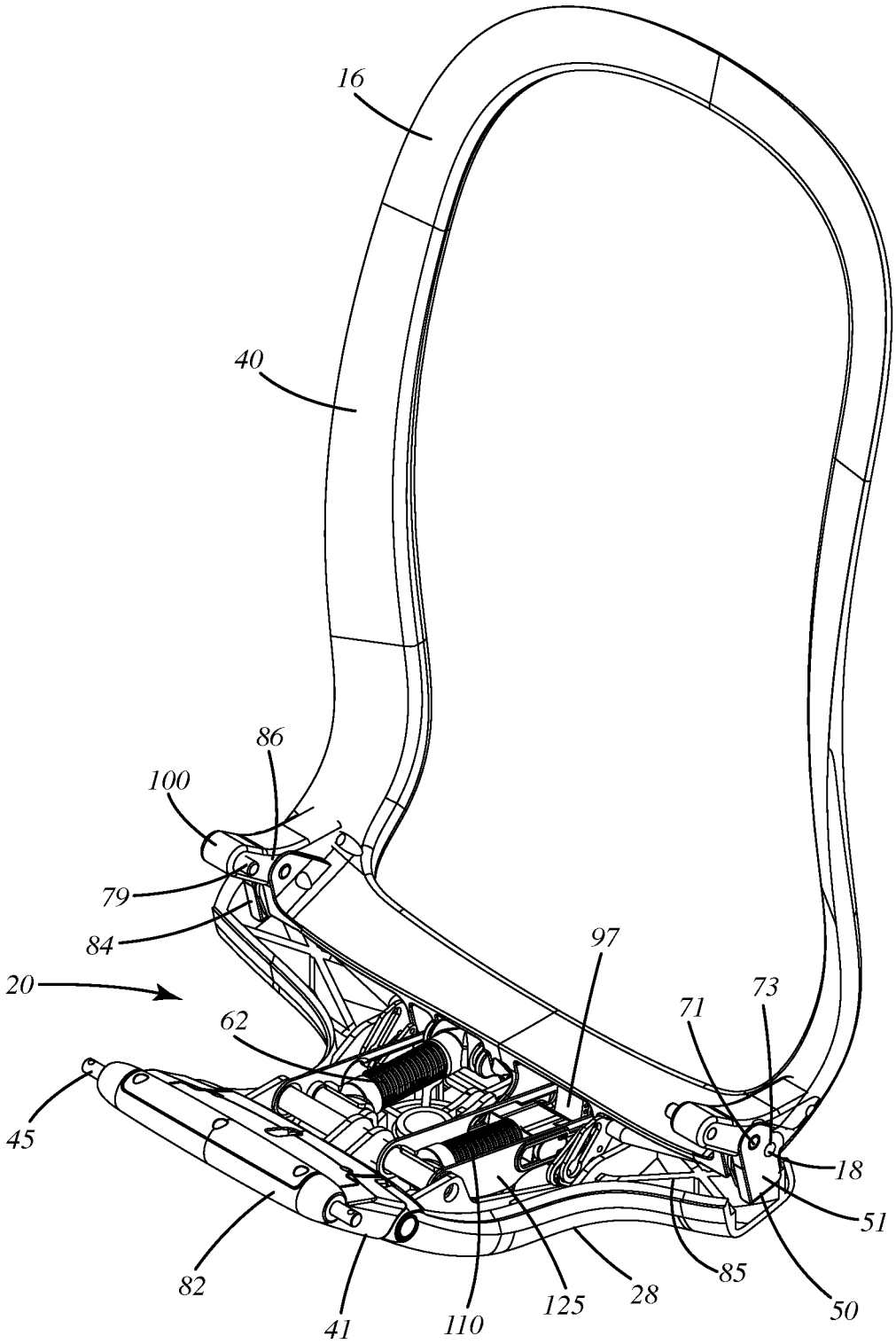
FIG. 9 is a cross sectional view of a portion of the chair taken along line 7-9 in FIG. 2, wherein the backrest is in an upright position and the seat is provided with a force exemplary of an occupant with a weight in the $50^{th}$ percentile.
Figure 10:
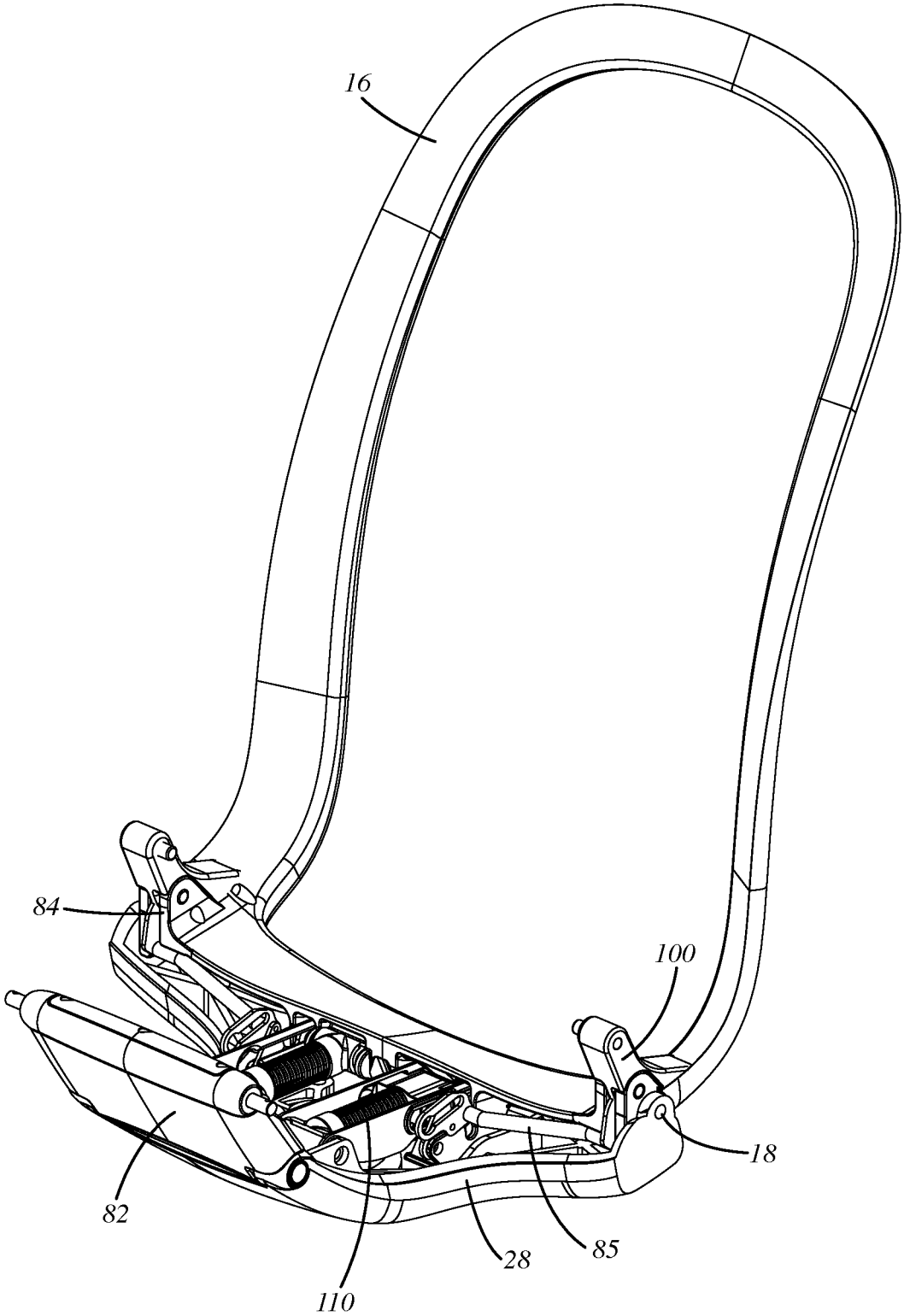
FIG. 10 is perspective view of a portion of the chair, wherein the backrest is in a reclined position and the seat is provided with a force exemplary of an occupant with a weight in the $5^{th}$ percentile.
Figure 11:
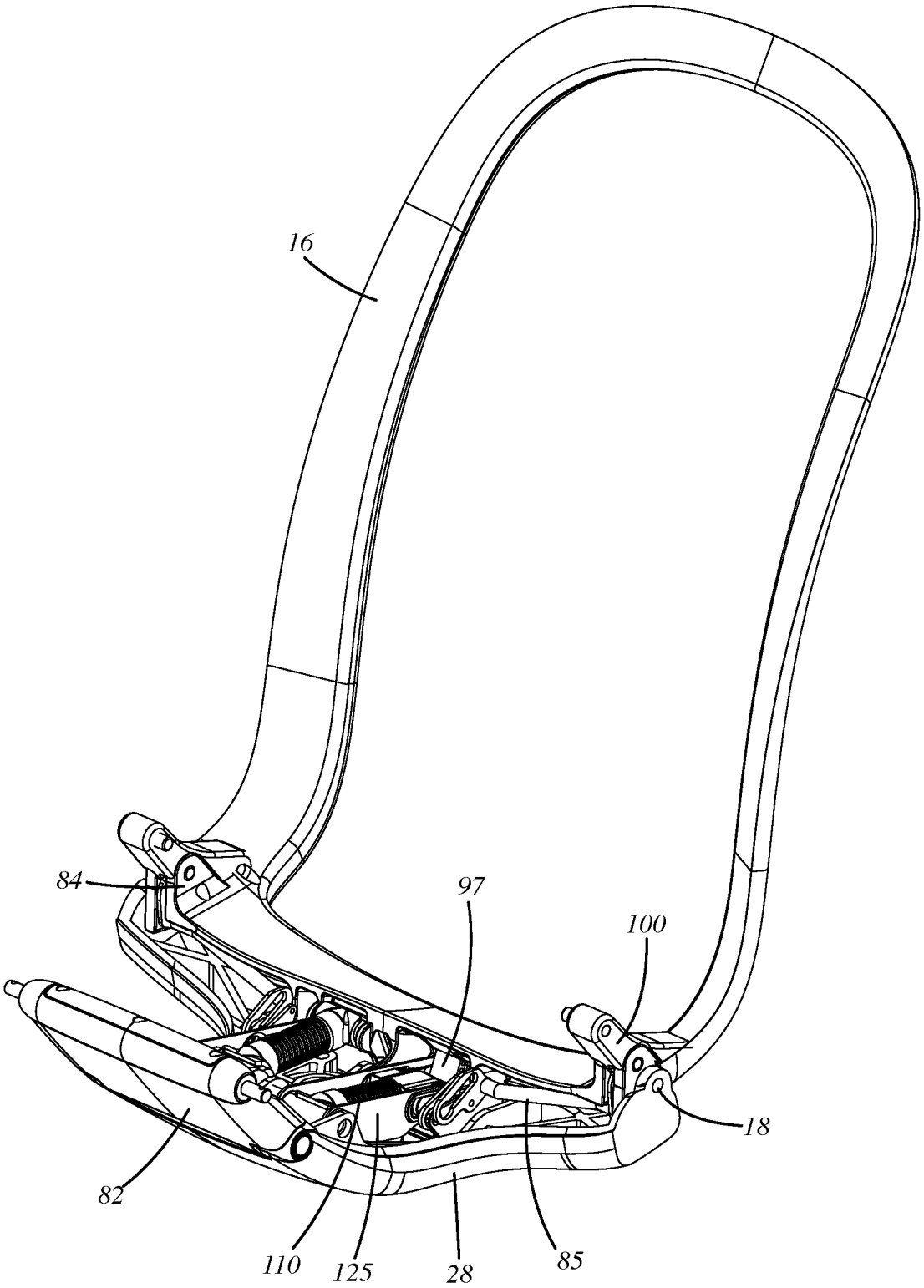
FIG. 11 is perspective view of a portion of the chair, wherein the backrest is in a reclined position and the seat is provided with a force exemplary of an occupant with a weight in the $50^{th}$ percentile.
Figure 12:
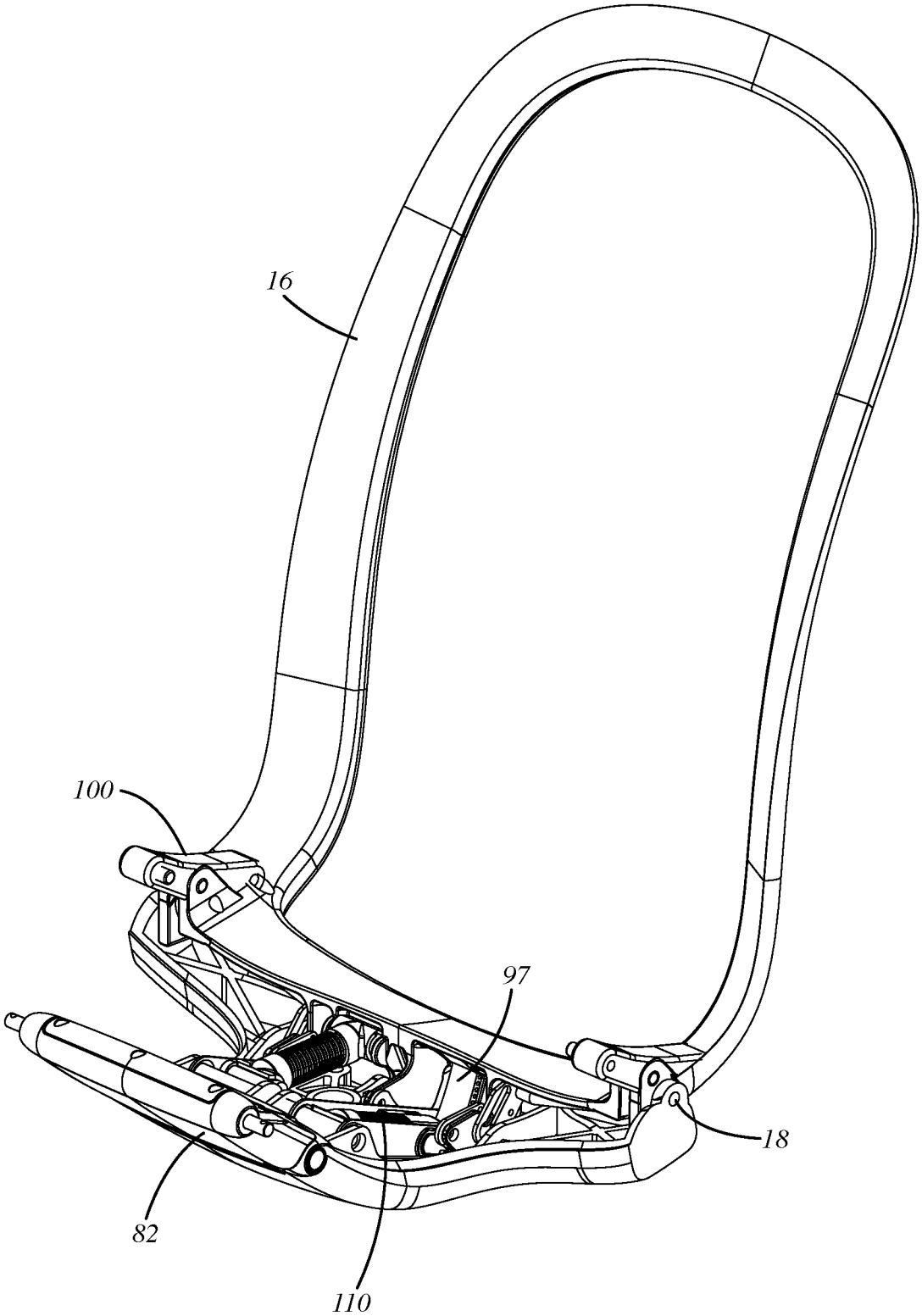
FIG. 12 is perspective view of a portion of the chair, wherein the backrest is in a reclined position and the seat is provided with a force exemplary of an occupant with a weight in the $95^{th}$ percentile.

FIGS. 1-6 show the spring 100 in an unloaded configuration, whereas FIGS. 7-9 show the spring 100 in a configuration where the seat 14 is occupied with a user in the $50^{th}$ weight percentile bracket, but with the backrest 16 upright. As a result, in this configuration, the seat 14 has been shifted forwardly from the backrest 16 and the recline axis 18, lengthening the moment arm between the seat 14 and the recline axis 18 and thus increasing the recline resistance from the unloaded state. For comparison, FIG. 10 shows the weight sensing mechanism 20 configured upon the seat 14 being loaded with an occupant in the $5^{th}$ weight percentile, FIG. 11 shows the weight sensing mechanism 20 configured upon the seat 14 being loaded with an occupant in the $50^{th}$ weight percentile, and FIG. 12 shows the weight sensing mechanism 20 configured upon the seat 14 being loaded with an occupant in the $95^{th}$ weight percentile. As shown in these FIGS. 10-12, the front 82 and rear 84 linkages are pivoted a first degree forwardly upon weight of the $5^{th}$ percentile, a second, greater degree forwardly upon the $50^{th}$ percentile occupant, and a third, greater degree forwardly upon the $95^{th}$ percentile occupant, progressively increasing the recline resistance as a function of increased occupant weight. In one embodiment, the weight of an occupant in the $5^{th}$ percentile may not be sufficient to pivot the weight sensing spring 100, such that a 5th percentile occupant experiences no increased resistance to recline.

Operation of the secondary spring 110 provides supplemental recline resistance as a function of the occupant's weight. FIG. 5 shows each of the drive linkage arms 85 connected between one of the upper rear links 86 and the projection on end slider 117, which is connected to the second end 113 of the spring 110. As a result of this connection, any pivoting of the upper rear link 86 causes pivoting of the drive linkage arm 85 via the adjustment linkage 93, which drives the end slider 117 and second end 113 of the spring 110 in a downward direction. The amount of movement of the upper rear link 86 is thus directly related to the amount of movement of the drive linkage arm 85, such that an occupant of greater weight will move the second end 113 of the spring 110 a greater distance than an occupant of lesser weight. FIG. 5 shows the chair 10 in an unloaded, and upright position, and in this position, the secondary spring 110 is generally parallel to the primary recline tension spring 62, and also generally parallel with the seat 14. As noted, FIGS. 7-9 show the chair 10 as if loaded with an occupant in the $50^{th}$ weight percentile, and with an upright backrest 16. In this configuration, the front and rear links 82, 84 are pivoted forward, and the second end 113 of the secondary spring 110 is pivoted downward such that it is lower than the second end 67 of the primary recline spring 62 and at an angle with respect to the seat 14. Although not shown in detail, in this upright configuration of the backrest 16, the indexer 119 is spaced from the index surface 99 on the indexer block 97 such that the secondary spring 110 can move freely. For example, if the occupant adjusted their weight while the backrest 16 is upright, the second end 113 of the secondary spring 110 could move freely as the force F on the seat 14 was varied.

Figure 13:
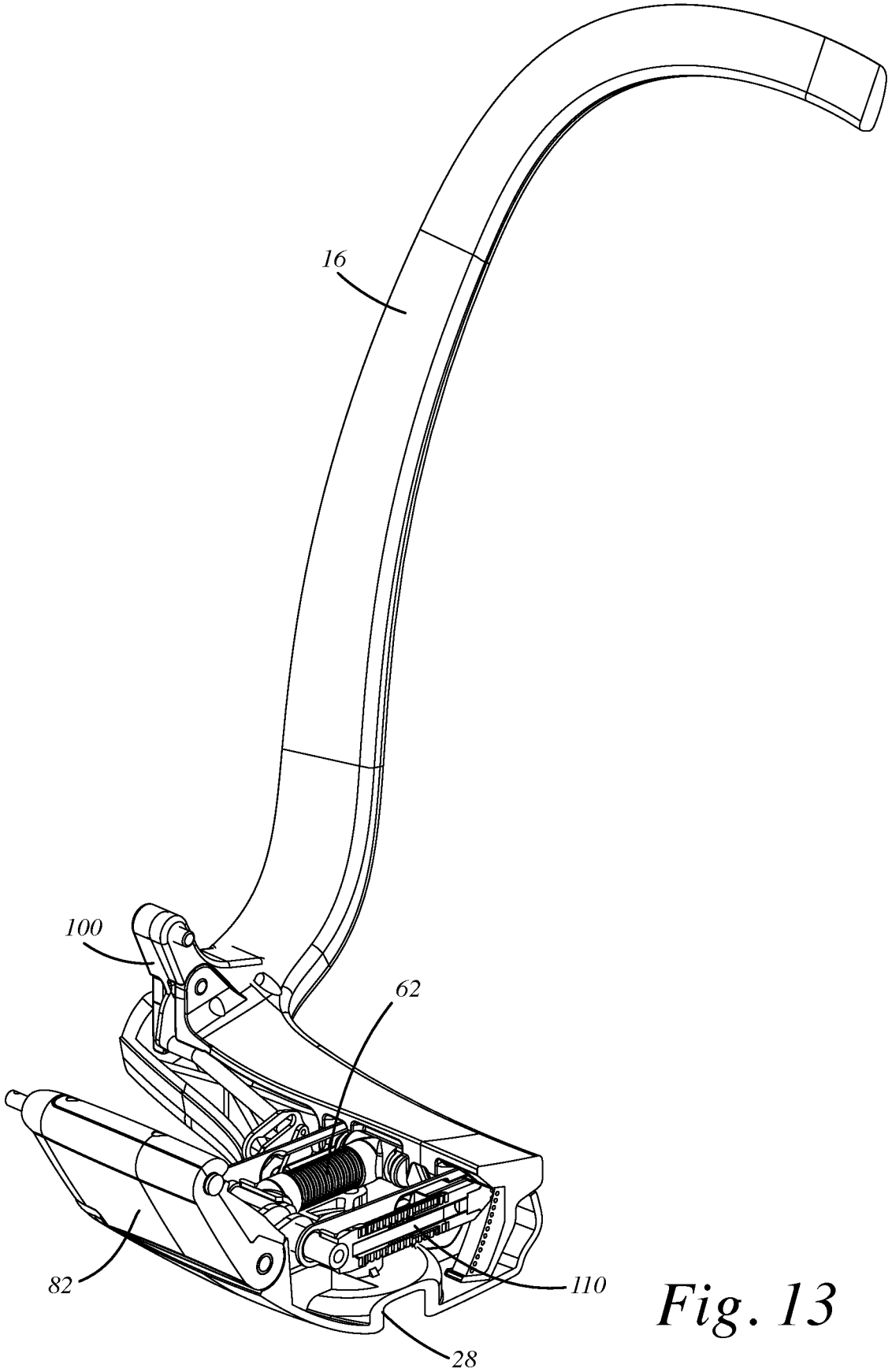
FIG. 13 is a cross sectional view of the chair of FIG. 10 taken along line 13-15 in FIG. 2.
Figure 14:
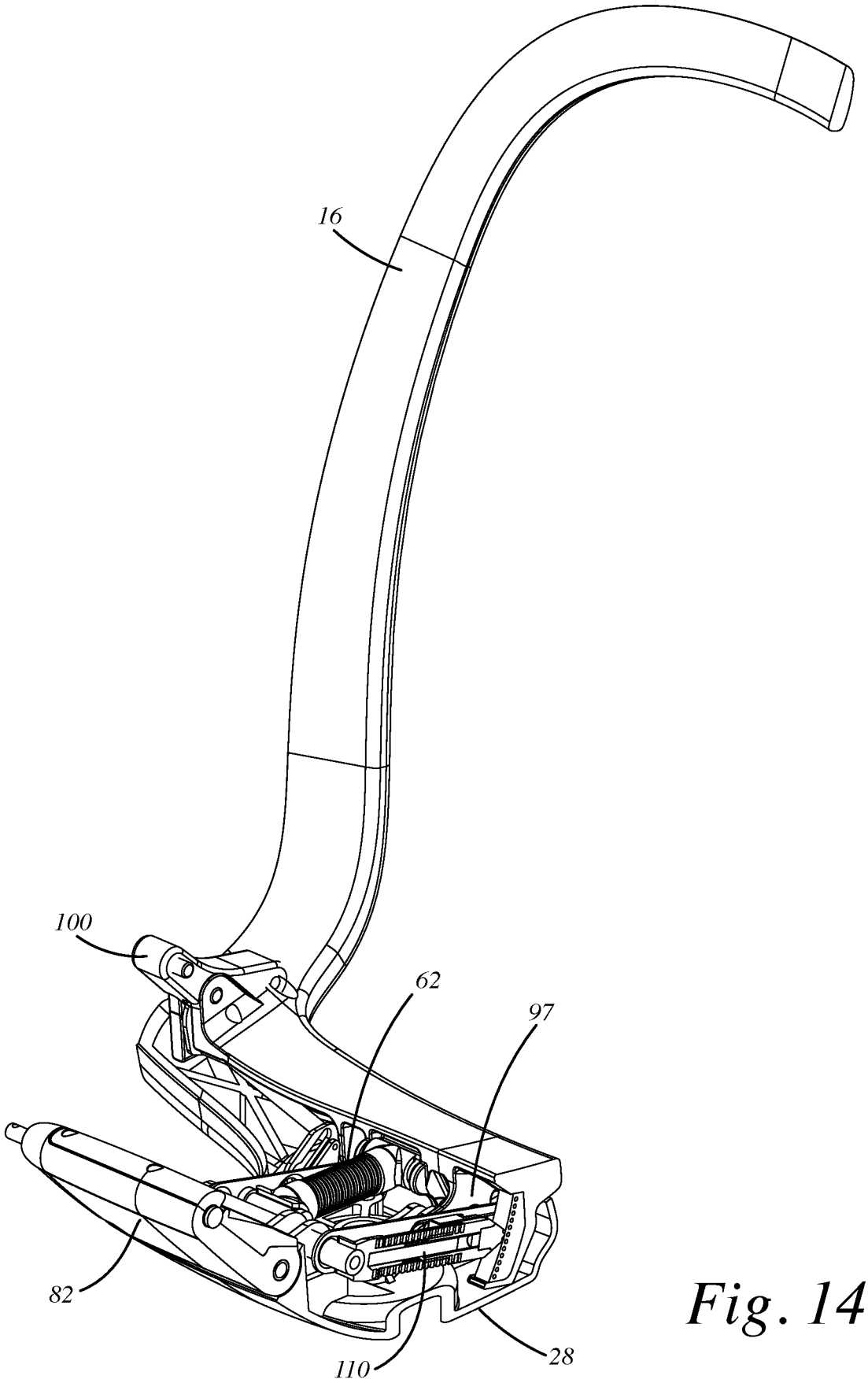
FIG. 14 is a cross sectional view of the chair of FIG. 11 taken along line 13-15 in FIG. 2.
Figure 15:
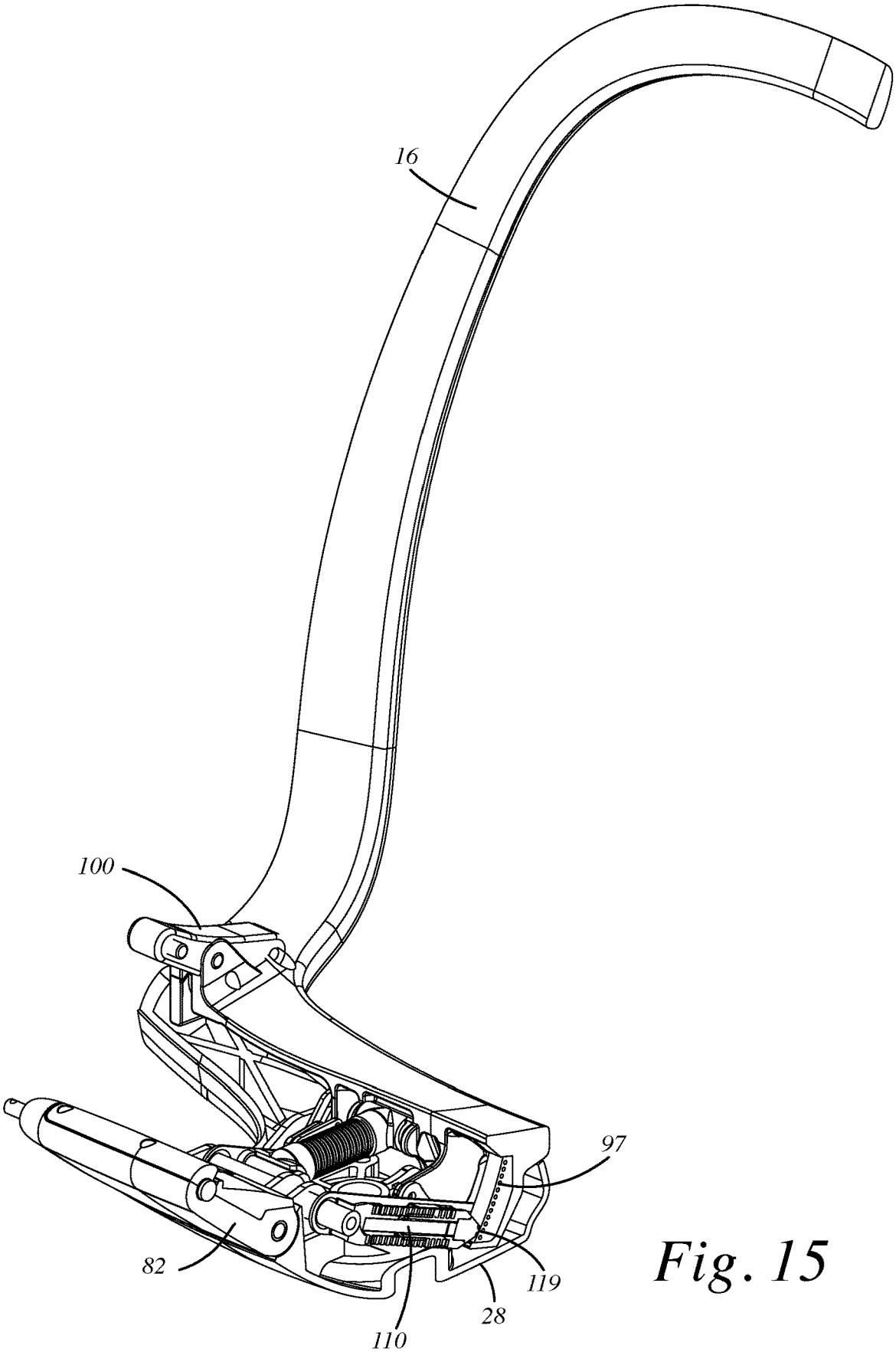
FIG. 15 is a cross sectional view of the chair of FIG. 12 taken along line 13-15 in FIG. 2.

FIGS. 10-15 show the operation of the weight sensing mechanism 20 and the secondary spring 110 with the backrest 16 in a reclined position. FIGS. 10 and 15 show the chair 10 in a configuration with an occupant in the $5^{th}$ weight percentile. In this configuration, the weight sensing spring 100 is slightly flexed and the front and rear links 82, 84 are pivoted forward a first degree. In addition, the pivoting of the upper rear link 86 has pivoted the drive linkage 85 a first degree and pivoted the second end 113 of the secondary spring 110 downward a first degree about the coupler 115. The resulting angle of the secondary spring 110 increases the recline resistance provided by the secondary spring 110. FIGS. 11 and 14 show the chair 10 in a configuration with an occupant in the $50^{th}$ weight percentile. In this configuration, the weight sensing spring 100 is flexed to a degree greater than in the configuration of FIGS. 10 and 15, and the front and rear links 82, 84 are pivoted forward a second degree that is greater than the first degree. In addition, the further pivoting of the upper rear link 86 has further pivoted the drive linkage 85 to a second degree and thus further pivoted the secondary spring 110 to a second, greater degree. FIGS. 12 and 15 show the chair 10 in a configuration with an occupant in the $95^{th}$ weight percentile. In this configuration, the weight sensing spring 100 is flexed to a degree greater than in the configuration of FIGS. 11 and 14, and the front and rear links 82, 84 are pivoted forward to a third degree that is greater than the second degree. In addition, the further pivoting of the upper rear link 86 has further pivoted the drive linkage 85 to a third degree and thus further pivoted the secondary spring 110 to a third, greater degree. Both the weight sensing mechanism 20 and the secondary spring 110 thus contribute to varying the recline resistance of the backrest 16 as a function of the weight of the occupant (i.e., as a function of the amount of force F on the seat 14).

Figure 16:
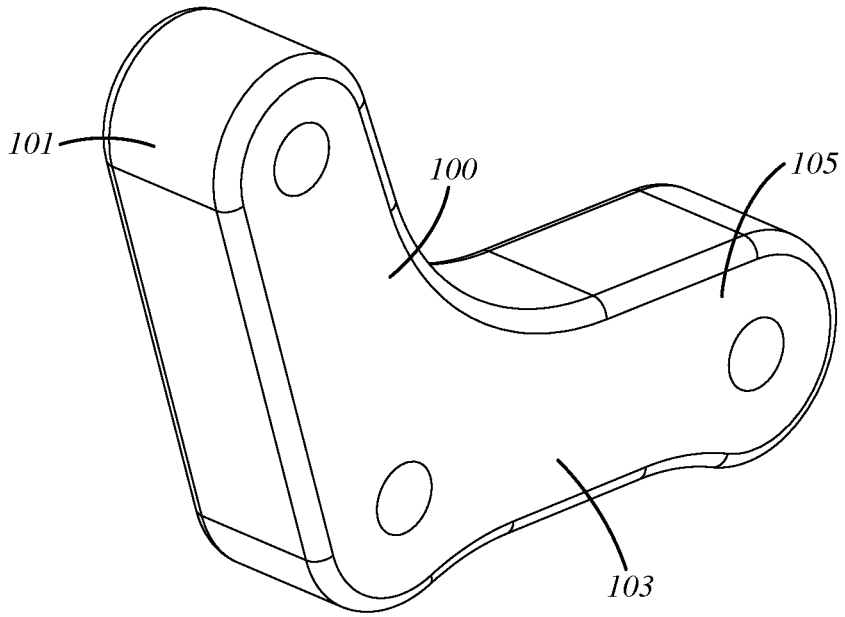
FIG. 16 is a perspective view of the weight sensing spring in an unflexed position.
Figure 17:
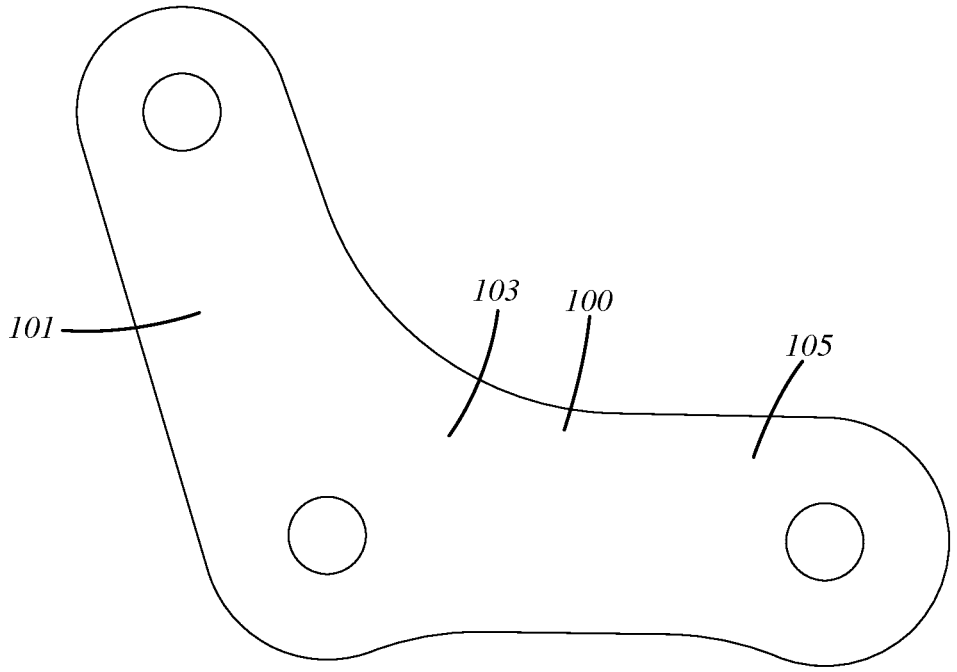
FIG. 17 is a front view of the weight sensing spring in an unflexed position.
Figure 18:
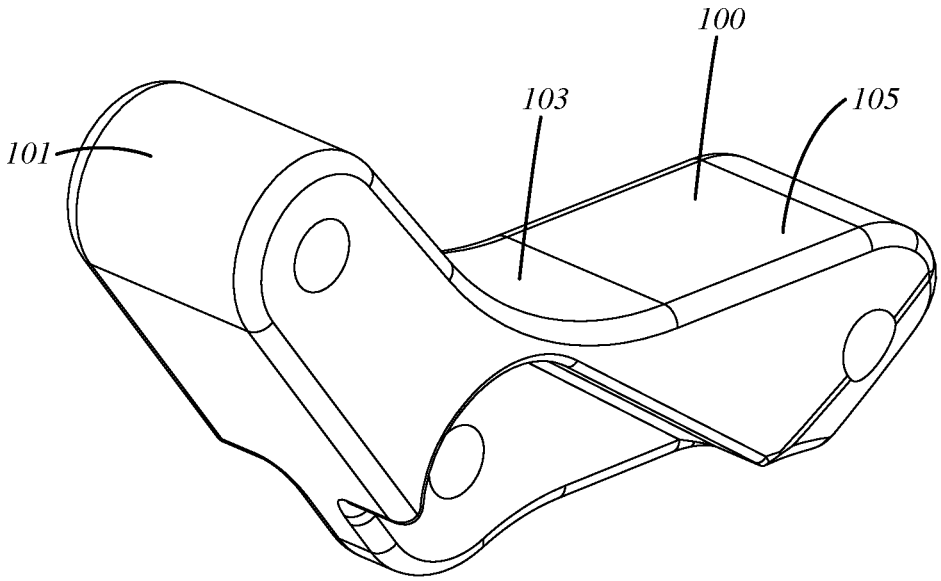
FIG. 18 is a perspective view of the weight sensing spring in a first flexed position.
Figure 19:
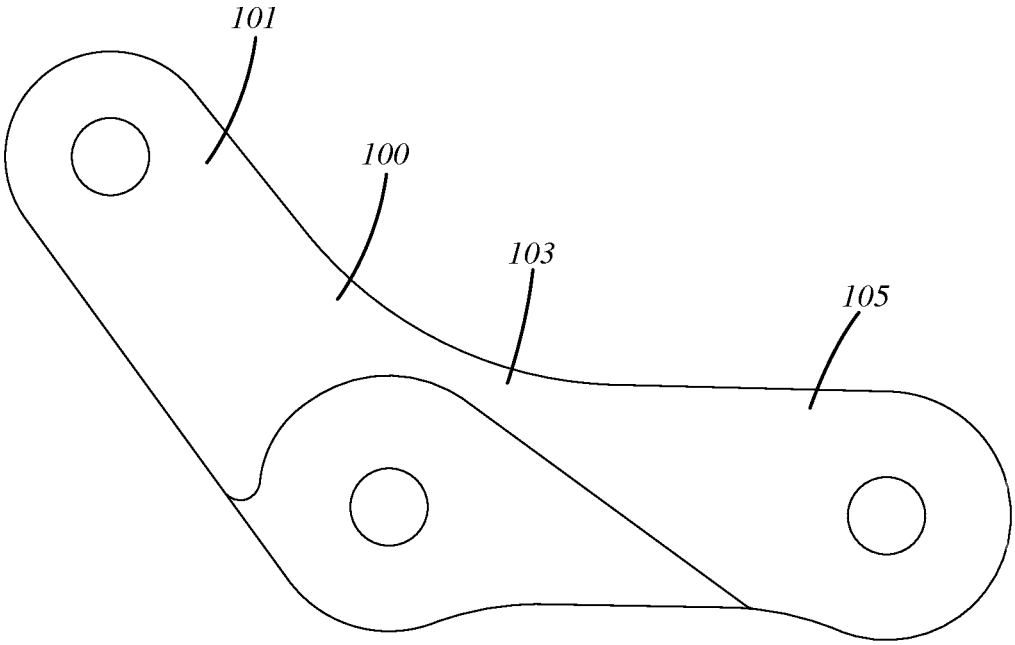
FIG. 19 is a front view of the weight sensing spring in a first flexed position.
Figure 20:
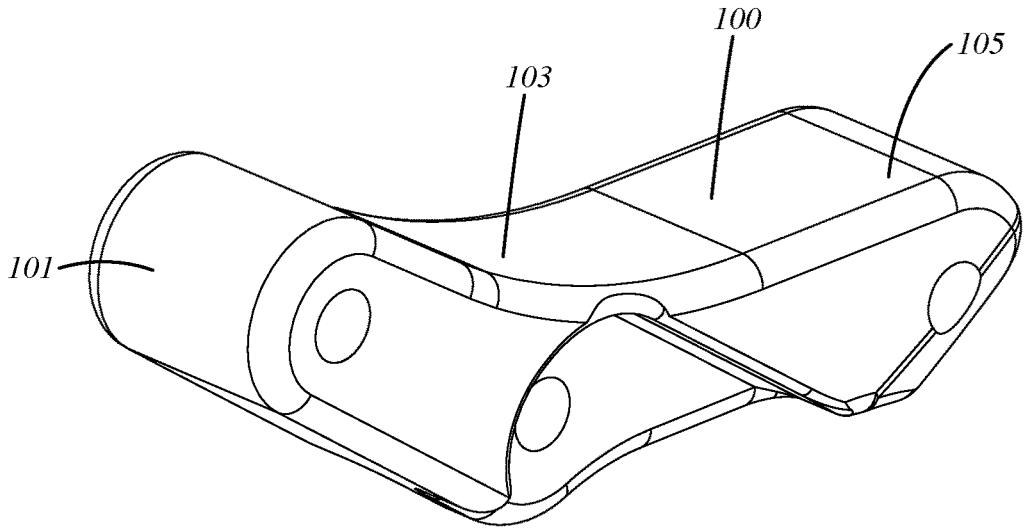
FIG. 20 is a perspective view of the weight sensing spring in a second flexed position.
Figure 21:
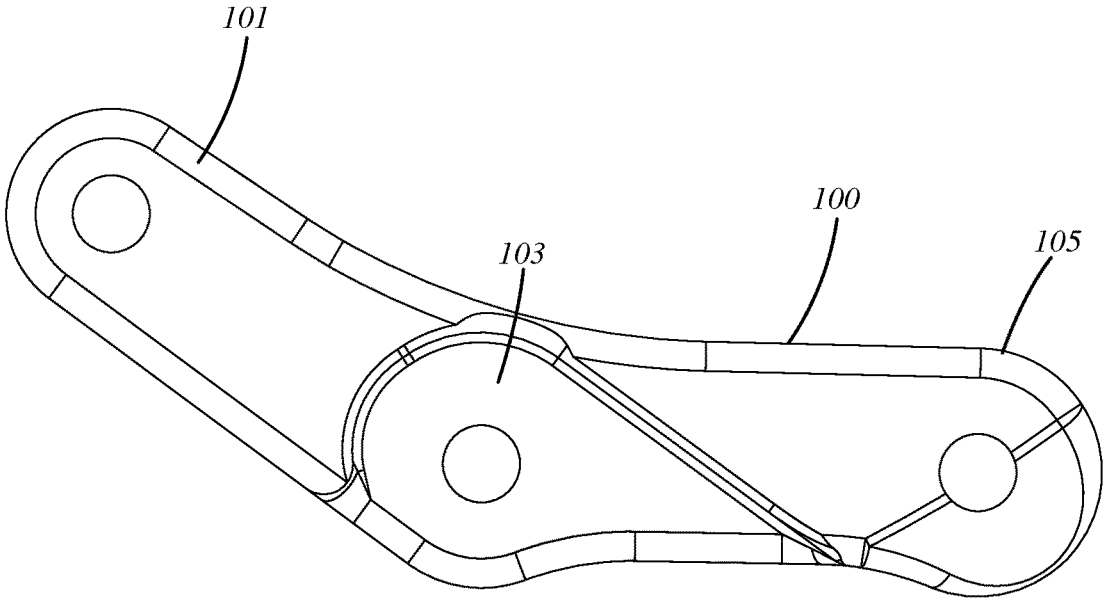
FIG. 21 is a front view of the weight sensing spring in a second flexed position.
Figure 22:
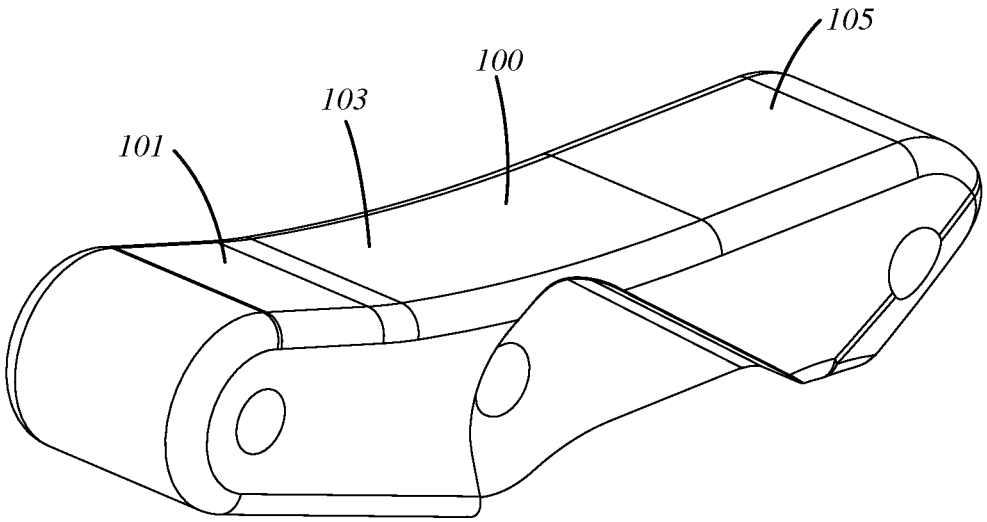
FIG. 22 is a perspective view of the weight sensing spring in a third flexed position.
Figure 23:
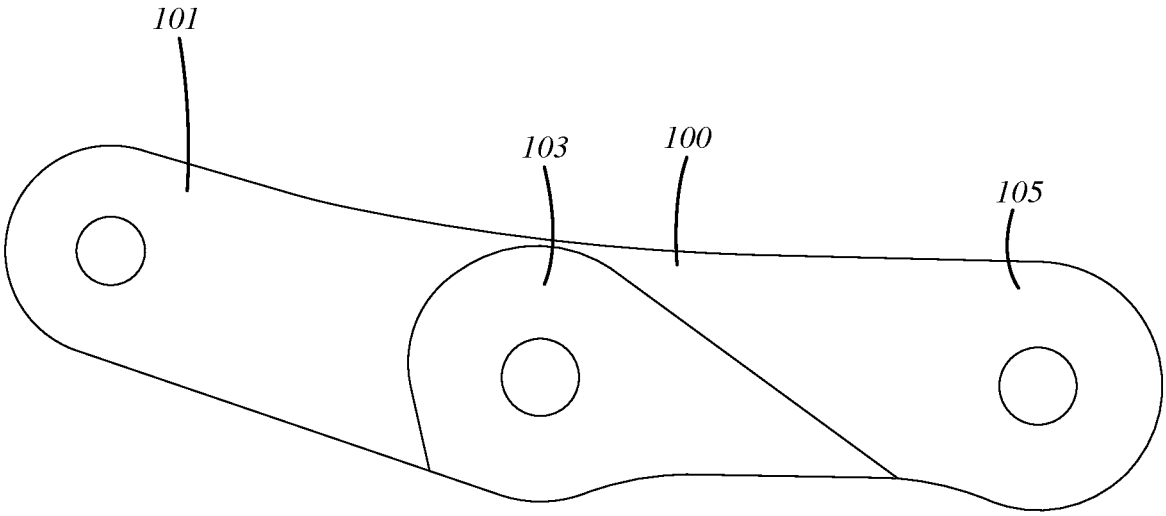
FIG. 23 is a front view of the weight sensing spring in a third flexed position.

FIGS. 16-23 show and isolated view of the current embodiment of the weight sensing spring 100, wherein the weight sensing spring 100 is a V-shaped member having a first leg 101, a base 103, and a second leg 105. As noted above, in this embodiment, the first leg 101 is coextensive and attached to the upper rear link 86, and the second leg 105 is attached to the backrest 16. FIGS. 16 and 17 show isolated representations of the weight sensing spring 100 in an unflexed position, representing the position of the spring when the seat 14 is unloaded. FIGS. 18 and 19 show isolated representations of the weight sensing spring 100 in a first flexed position representing an occupant with a weight in the $5^{th}$ percentile on the seat 14, wherein the first leg 101 is flexed slightly away from the second leg 105. FIGS. 20 and 21 show isolated representations of the weight sensing spring 100 in a second flexed position representing an occupant with a weight in the $50^{th}$ percentile on the seat 14, wherein the first leg 101 is flexed slightly farther away from the second leg 105. FIGS. 22 and 23 show isolated representations of the weight sensing spring 100 in a third flexed position representing an occupant with a weight in the $95^{th}$ percentile on the seat 14, wherein the first leg 101 is flexed slightly farther away from the second leg 105. As noted above, other configurations of weight sensing spring 100 may also be used.

As shown in FIGS. 13-15, when the backrest 16 is reclined, the indexer block 97 and index surface 99 are pivoted forward and into contact with the indexer 119. As a result of an occupant generally sitting on the seat 14 prior to reclining the backrest 16, when the indexer block 97 is pivoted forward, the indexer 119 will contact the index surface 99 at a position along the vertical extent of the index surface 99 that depends on the position of the indexer 119 set by the weight of the occupant. Put another way, as a force F is exerted on the seat 14, the weight sensing mechanism 20 will pivot the seat 14 forwardly a degree that is dependent on the weight of the user. At the same time, the pivoting of the drive linkage 95 will cause the secondary spring 110 to pivot about the coupler bracket 115 and move the second end 113 of the secondary spring 110 downward an amount dependent on the weight of the occupant. Subsequent reclining of the backrest 16 by the occupant will cause the indexer 119 to contact the index surface 99 at the adjusted position of the indexer 119. As the indexer 119 engages the index surface 99, the indexer 119 will insert or interfit with one of the detents along the vertical extent of the indexer block 97, and be retained in that vertical position on the indexer block 97 for the duration of the period that the backrest 16 is reclined. Subsequent movement of the backrest 16 to the upright position will pivot the indexer block 97 away from the indexer 119 to enable further movement of the indexer 119 and the secondary spring 110. In the configuration shown in FIG. 13, wherein the seat is occupied by an occupant in the $5^{th}$ weight percentile, the indexer 119 is retained in a detent near the top edge 127 of the indexer block 97. In the configuration shown in FIG. 14, wherein the seat is occupied by an occupant in the $50^{th}$ weight percentile, the indexer 119 is retained in a detent at approximately the midpoint between the top edge 129 and the bottom edge 129 of the index block 97. And in the configuration shown in FIG. 15, wherein the seat is occupied by an occupant in the $95^{th}$ weight percentile, the indexer 119 is retained in a detent near the bottom edge 129. Notably, variations in the material of the indexer block 97 or the indexer 119, and variations in the depth and positioning of the detents on the indexer block 97 will impact the ability of the indexer block 97 to retain the indexer in position. Some constructions my enable a degree of "slip" by the indexer from detent to detent.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Features of various embodiments may be used in combination with features from other embodiments. Directional terms, such as "vertical," "horizontal," "top," "bottom," "front," "rear," "upper," "lower," "inner," "inwardly," "outer," "outwardly," "forward," and "rearward" are used to assist in describing the invention based on the orientation of the embodiments shown in the illustrations. The use of directional terms should not be interpreted to limit the invention to any specific orientation(s). Any reference to claim elements in the singular, for example, using the articles "a," "an," "the" or "said" is not to be construed as limiting the element to the singular.

The embodiments of the invention in which an exclusive property or privilege is claimed are defined as follows:

1. A chair comprising:

a base including a ground engaging portion;

a seat supported on the base;

a backrest connected to the seat and the base, the backrest pivotally connected to the base at a recline axis, the backrest pivotable about the recline axis between an upright position and a reclined position;

a recline tension spring biasing the backrest in the upright position; and a weight responsive mechanism including:

a front link pivotally connected between the base and the seat, a rear link pivotally connected between the seat and the backrest, and a resilient element connected between the seat, the rear link and the backrest, wherein the force of a user occupying the seat pivots the front link and the rear link against a resistance created by the resilient element an amount proportional to the weight of the user to move the seat downwardly towards the base and forwardly away from the recline axis and increase the effective length of the moment arm between the user and the recline axis, such that the force to pivot the backrest about the recline axis varies as a function of the weight of the user.

2. A chair comprising:

a base including a ground engaging portion;

a seat supported on the base;

a backrest connected to the seat and the base, the backrest pivotally connected to the base at a recline axis, the backrest pivotable about the recline axis between an upright position and a reclined position;

a recline tension spring biasing the backrest in the upright position; and a weight responsive mechanism including:

a front link pivotally connected between the base and the seat, a rear link pivotally connected between the seat and the backrest, and a resilient element connected between the seat, the rear link and the backrest, wherein the force of a user occupying the seat pivots the front link and the rear link against a resistance created by the resilient element an amount proportional to the weight of the user to increase the effective length of the moment arm between the user and the recline axis, such that the force to pivot the backrest about the recline axis varies as a function of the weight of the user; and including a secondary recline spring between the base and the backrest, the secondary recline spring contributing to the biasing force of the recline tension spring when the backrest is moved to the reclined position.

3. The chair of claim 2 wherein the secondary spring is unloaded when the backrest is in the upright position.

4. The chair of claim 3 wherein the amount of contribution of the secondary spring acting to bias the backrest in the upright position is adjustable when the backrest is in the upright position.

5. The chair of claim 4 wherein the secondary spring is a compression coil spring having a first end and a second end, the first end fixed in position on the base, the second end adjustably positioned on the backrest, wherein adjustment of the second end of the secondary spring changes a distance between the second end and the recline axis and changes the amount of contribution of the secondary spring to the recline resistance.

6. The chair of claim 5 wherein the secondary spring dynamically adjusts as a function of the weight of the user.

7. The chair of claim 6 wherein the second end of the secondary spring is caused to move with respect to the backrest in response to the weight of a user sitting on the seat.

8. The chair of claim 7 including a drive linkage connected between the seat and the second end of the secondary spring, wherein movement of the seat upon a force provided by the weight of a user causes movement of the second end of the spring.

9. The chair of claim 8 wherein the backrest includes an index surface, and wherein the second end of the secondary spring includes an indexer connected to the second end of the spring, the indexer retained in place by the index surface when the backrest is reclined.

10. A chair comprising:

a base having a ground engaging portion and a mechanism portion;

a seat for supporting a user; and a backrest connected to the seat and the base, the backrest pivoting with respect to the base between an upright position and a reclined position about a recline axis, the backrest biased in the upright position by a recline spring;

wherein the seat is supported on the base by a four-bar linkage, the four-bar linkage including the seat, the mechanism portion of the base, a front link between the seat and the mechanism portion of the base, and a rear link between the seat and the mechanism portion of the base, wherein the rear link includes an upper rear link and a lower rear link, the upper link connected to the seat, and the lower rear link connected to the base;

wherein the four-bar linkage is biased in a first position by a weight sensing spring;

wherein a force from a user sitting on the seat acts against the weight sensing spring and pivots the front link, the upper rear link and the seat downward and forward with respect to the backrest and the recline axis and increases the distance between at least a portion of the seat and the recline axis.

11. A chair comprising:

a base having a ground engaging portion and a mechanism portion;

a seat for supporting a user; and a backrest connected to the seat and the base, the backrest pivoting with respect to the base between an upright position and a reclined position about a recline axis, the backrest biased in the upright position by a recline spring;

wherein the seat is supported on the base by a four-bar linkage, the four-bar linkage including the seat, the mechanism portion of the base, a front link between the seat and the mechanism portion of the base, and a rear link between the seat and the mechanism portion of the base, wherein the rear link includes an upper rear link and a lower rear link, the upper link connected to the seat, and the lower rear link connected to the base;

wherein the four-bar linkage is biased in a first position by a weight sensing spring;

wherein a force from a user sitting on the seat acts against the weight sensing spring and pivots the front link, the upper rear link and the seat forward with respect to the recline axis and increases the distance between at least a portion of the seat and the recline axis; and including a secondary recline spring between the base and the backrest, the secondary spring contributing to the biasing force of the recline tension spring when the backrest is moved to the reclined position.

12. The chair of claim 11 wherein the secondary recline spring includes a first end connected to the mechanism portion of the base and a second end connected to the backrest, wherein the position of the second end is adjustable with respect to the position of the recline axis.

13. The chair of claim 12 wherein the secondary recline spring is dynamically adjustable as a function of the user's weight.

14. The chair of claim 10 wherein the weight sensing spring is a resilient material, and wherein a first portion of the weight sensing spring is connected to the upper rear link.

15. The chair of claim 14 wherein the weight sensing spring is capable of flexing from an upright position to a forward position upon the force of the weight of a user sitting on the seat.

16. The chair of claim 15 wherein the upper rear link includes a first end mounted to the seat, and a second end pivotally connected to the lower rear link at a rear seat pivot axis.

17. The chair of claim 16 wherein the weight sensing spring includes a second portion that extends from the rear seat pivot axis to the backrest, the second portion flexing as the upper rear link is pivoted.

18. The chair of claim 17 wherein the weight sensing spring is a one-piece, V-shaped resilient member having a first leg that is coextensive with the upper rear link and forms the first portion of the weight sensing spring and extends between the seat and the rear seat pivot axis and a second leg that extends from the seat pivot axis to the backrest and forms the second portion of the weight sensing spring.

19. The chair of claim 18 wherein the lower rear link is pivotally connected to the upper rear link at the rear seat pivot axis, and pivotally connected to the mechanism portion of the base at the recline axis.

20. A chair comprising:

a base;

a backrest supported by the base at a recline axis, the backrest pivotable about the recline axis between an upright position and a reclined position, the backrest biased in the upright position by a recline spring;

a seat supported by the base and having a surface for supporting an occupant; and a weight responsive mechanism adjusting the force required to pivot the backrest to the recline position as a result of an occupant sitting on the seat, independent of the pivoting of the backrest, and as a function of the weight of the occupant, the weight responsive mechanism including:

a front link between the base and the seat, an upper rear link between the seat and the backrest, a lower rear link between the upper rear link and the base, the backrest attached to the lower rear link, and a weight sensing spring urging the upper rear link toward a first position, wherein the force of an occupant on the surface of the seat acts against the weight sensing spring to pivot the front link and the upper rear link out of the first position and downwardly and away from the backrest.

* * * * *